US009978303B2

(12) United States Patent
Hayashi et al.

(10) Patent No.: US 9,978,303 B2
(45) Date of Patent: May 22, 2018

(54) DISPLAY DEVICE AND ELECTRONIC APPARATUS

(71) Applicant: Japan Display Inc., Tokyo (JP)

(72) Inventors: Shuji Hayashi, Tokyo (JP); Takayuki Nakanishi, Tokyo (JP); Tatsuya Yata, Tokyo (JP)

(73) Assignee: Japan Display Inc., Tokyo (JP)

( * ) Notice: Subject to any disclaimer, the term of this patent is extended or adjusted under 35 U.S.C. 154(b) by 10 days.

(21) Appl. No.: 14/986,912

(22) Filed: Jan. 4, 2016

(65) Prior Publication Data

US 2016/0203752 A1 Jul. 14, 2016

(30) Foreign Application Priority Data

Jan. 8, 2015 (JP) ..... 2015-002655

(51) Int. Cl.
*G09G 3/20* (2006.01)
*G09G 3/3225* (2016.01)

(52) U.S. Cl.
CPC ..... *G09G 3/2074* (2013.01); *G09G 3/2003* (2013.01); *G09G 3/3225* (2013.01); *G09G 2300/0452* (2013.01); *G09G 2320/0233* (2013.01); *G09G 2320/0238* (2013.01); *G09G 2320/0673* (2013.01); *G09G 2340/06* (2013.01); *G09G 2370/08* (2013.01); *G09G 2380/10* (2013.01)

(58) Field of Classification Search
CPC ... G09G 3/2074; G09G 3/3225; G09G 3/2003
See application file for complete search history.

(56) References Cited

U.S. PATENT DOCUMENTS 8,159,498 B2 * 4/2012 Higgins ..... G09G 3/2003 345/581
8,189,016 B2 * 5/2012 Higgins ..... G09G 3/3406 345/102
2007/0279372 A1 * 12/2007 Brown Elliott ..... G09G 3/3426 345/102
2008/0084524 A1 * 4/2008 Inuzuka ..... G09G 3/3413 349/108
2008/0150970 A1 6/2008 Ozawa et al.
(Continued)

FOREIGN PATENT DOCUMENTS

JP 2008-158401 7/2008

*Primary Examiner* — Nicholas Lee
*Assistant Examiner* — Robert Stone
(74) *Attorney, Agent, or Firm* — K&L Gates LLP

(57) ABSTRACT

A display device includes: an image display panel including pixels each including a first to a forth sub-pixel that display a first color to a fourth color; and a signal processing unit. The signal processing unit stores an expanded color space, determines maximum set brightness as an upper limit value of brightness displayable within a range of the brightness in the expanded color space so that the maximum set brightness increases as a panel average input value decreases, determines an input expansion coefficient for expanding the color displayed by the image display panel to a color of the maximum set brightness, obtains the output signal of the first to forth sub-pixel based on the input signal of the first to third sub-pixel and the input expansion coefficient. The expanded color space is a color space that can extend a color of brightness higher than that in a standard color space.

8 Claims, 24 Drawing Sheets

(56) References Cited

U.S. PATENT DOCUMENTS

| | | | | |
|---|---|---|---|---|
| 2008/0284719 | A1* | 11/2008 | Yoshida | G02F 1/136277 345/102 |
| 2009/0174638 | A1* | 7/2009 | Brown Elliott | G02F 1/133621 345/88 |
| 2010/0007679 | A1* | 1/2010 | Sakaigawa | G09G 3/3406 345/690 |
| 2011/0181634 | A1* | 7/2011 | Higashi | G09G 3/3426 345/691 |
| 2012/0050345 | A1* | 3/2012 | Higashi | G09G 3/3426 345/690 |
| 2012/0287168 | A1* | 11/2012 | Botzas | G09G 3/3413 345/690 |
| 2013/0027441 | A1* | 1/2013 | Kabe | G09G 3/3413 345/690 |
| 2014/0218386 | A1* | 8/2014 | Tatsuno | G09G 3/3607 345/590 |

* cited by examiner

DISPLAY DEVICE AND ELECTRONIC APPARATUS

CROSS-REFERENCE TO RELATED APPLICATIONS

This application claims priority from Japanese Application No. 2015-002655, filed on Jan. 8, 2015, the contents of which are incorporated by reference herein in its entirety.

BACKGROUND

1. Technical Field

The present disclosure relates to a display device and an electronic apparatus.

2. Description of the Related Art

In an image display panel constituted of a plurality of pixels including a first sub-pixel that displays red, a second sub-pixel that displays green, and a third sub-pixel that displays blue, for example, a luminance difference (value (also called as brightness) difference) among pixels within one frame may be increased in some cases to clearly display an image. When there is a bright portion in part of an image that is dark as a whole, for example, the luminance difference between the bright portion and a dark portion can be increased by increasing the luminance difference between the pixels in a screen, and a dynamic range is widened, which improves contrast of the image.

For example, Japanese Patent Application Laid-open Publication No. 2008-158401 discloses a technique of increasing a luminance difference among pixels in a screen by adjusting a gamma curve used for gamma conversion of an input signal.

However, even though the gamma curve is adjusted, a maximum value and a minimum value of the brightness (luminance) of each pixel are not changed. Thus, even though the gamma curve is adjusted, there is a possibility that a sufficient dynamic range cannot be obtained and the contrast is not improved enough.

To solve the above problem, the present invention provides a display device and an electronic apparatus for appropriately improving the contrast of the image.

SUMMARY

According to an aspect, A display device including an image display panel including a plurality of pixels each including a first sub-pixel that displays a first color, a second sub-pixel that displays a second color, a third sub-pixel that displays a third color, and a fourth sub-pixel that displays a fourth color; and a signal processing unit that generates an output signal from an input value of an input signal, and outputs the output signal to the image display panel. The signal processing unit stores an expanded color space extended with the first color, the second color, the third color, and the fourth color, determines maximum set brightness as an upper limit value of brightness of a color displayed by the image display panel so that the maximum brightness is within a range of the brightness in the expanded color space, and the maximum set brightness increases as a panel average input value calculated based on an average value of input values of input signals to the pixels within one frame decreases. The signal processing unit determines an input expansion coefficient for expanding the color displayed by the image display panel to a color of the maximum set brightness. The signal processing unit obtains an input expansion signal of the first sub-pixel based on an input signal of the first sub-pixel and the input expansion coefficient. The signal processing unit obtains an input expansion signal of the second sub-pixel based on an input signal of the second sub-pixel and the input expansion coefficient. The signal processing unit obtains an input expansion signal of the third sub-pixel based on an input signal of the third sub-pixel and the input expansion coefficient. The signal processing unit obtains an output signal of the first sub-pixel based on the input expansion signal of the first sub-pixel and outputs the output signal to the first sub-pixel. The signal processing unit obtains an output signal of the second sub-pixel based on the input expansion signal of the second sub-pixel and outputs the output signal to the second sub-pixel. The signal processing unit obtains an output signal of the third sub-pixel based on the input expansion signal of the third sub-pixel and outputs the output signal to the third sub-pixel. The signal processing unit obtains an output signal of the fourth sub-pixel based on the input expansion signal of the first sub-pixel, the input expansion signal of the second sub-pixel, and the input expansion signal of the third sub-pixel and outputs the output signal to the fourth sub-pixel. The expanded color space is a color space that can extend a color of brightness higher than that in a standard color space extended with the first color, the second color, and the third color.

DETAILED DESCRIPTION

Figure 1:
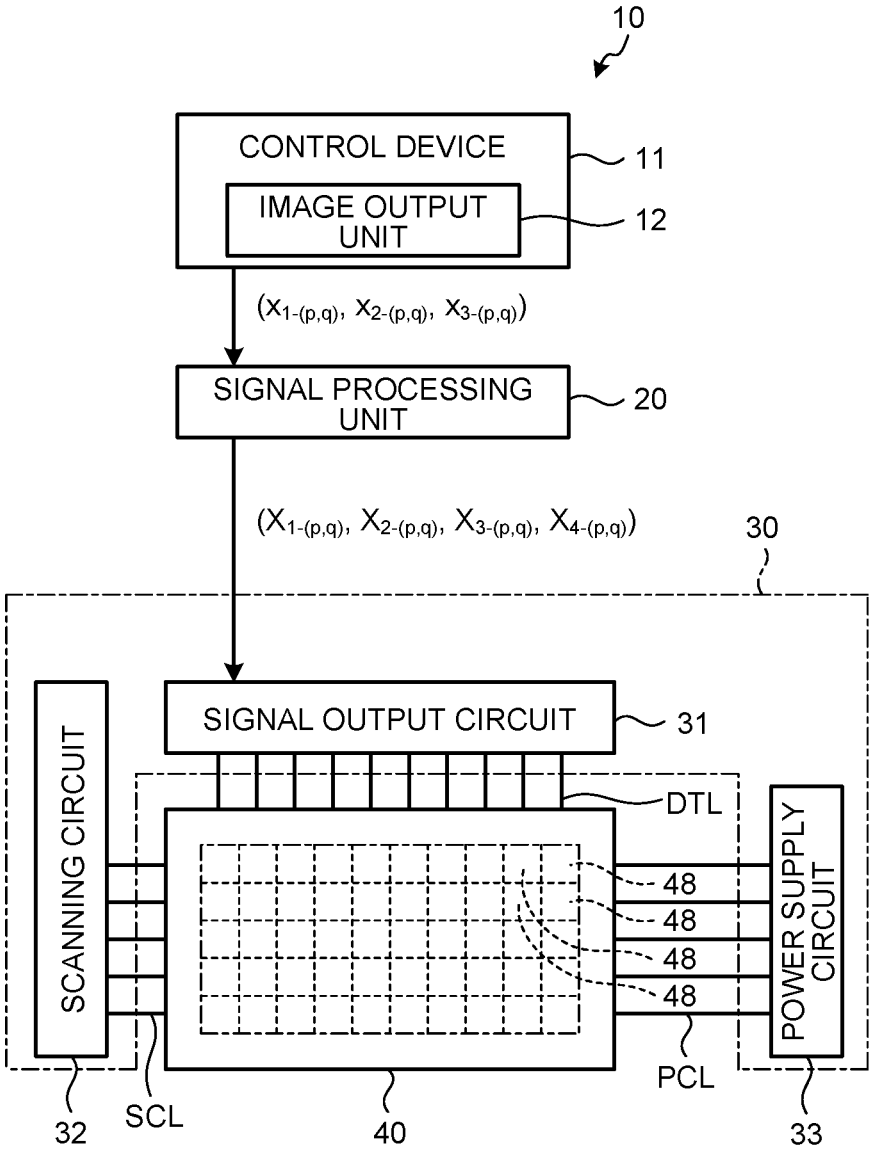
FIG. 1 is a block diagram illustrating an example of the configuration of a display device according to a first embodiment of the present invention.

The following describes embodiments of the present invention with reference to the drawings. The disclosure is merely an example, and the present invention naturally encompasses an appropriate modification maintaining the gist of the invention that is easily conceivable by those skilled in the art. To further clarify the description, a width, a thickness, a shape, and the like of each component may be schematically illustrated in the drawings as compared with an actual aspect. However, this is merely an example and interpretation of the invention is not limited thereto. The same element as that described in the drawing that has already been discussed is denoted by the same reference numeral through the description and the drawings, and detailed description thereof will not be repeated in some cases.

First Embodiment

Configuration of Display Device

FIG. 1 is a block diagram illustrating an example of the configuration of a display device according to a first embodiment of the present invention. As illustrated in FIG. 1, a display device 10 according to the first embodiment includes a signal processing unit 20, an image display panel driving unit 30, and an image display panel 40. The signal processing unit 20 receives an input signal (RGB data) input from an image output unit 12 of a control device 11, and transmits, to each unit of the display device 10, a signal generated by performing predetermined data conversion processing on the input signal. The image display panel driving unit 30 controls driving of the image display panel 40 based on the signal from the signal processing unit 20. The image display panel 40 is a self-luminous type image display panel that lights a self-luminous body of a pixel to display an image based on a signal from the image display panel driving unit 30.

Configuration of Image Display Panel

Figure 2:
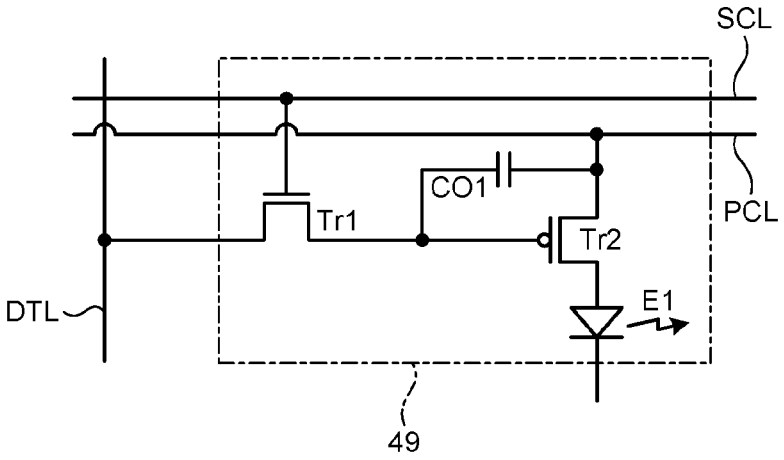
FIG. 2 is a diagram illustrating a lighting drive circuit of a sub-pixel included in a pixel of an image display panel according to the first embodiment.
Figure 3:
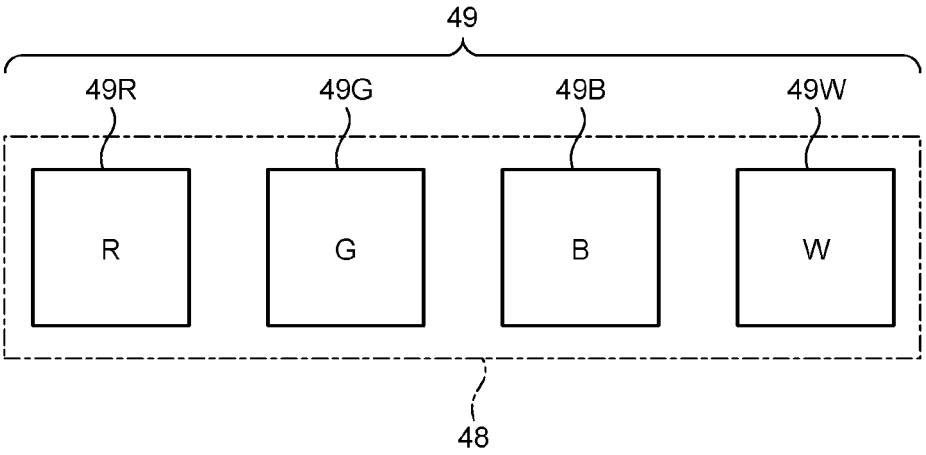
FIG. 3 is a diagram illustrating an array of sub-pixels of the image display panel according to the first embodiment.
Figure 4:
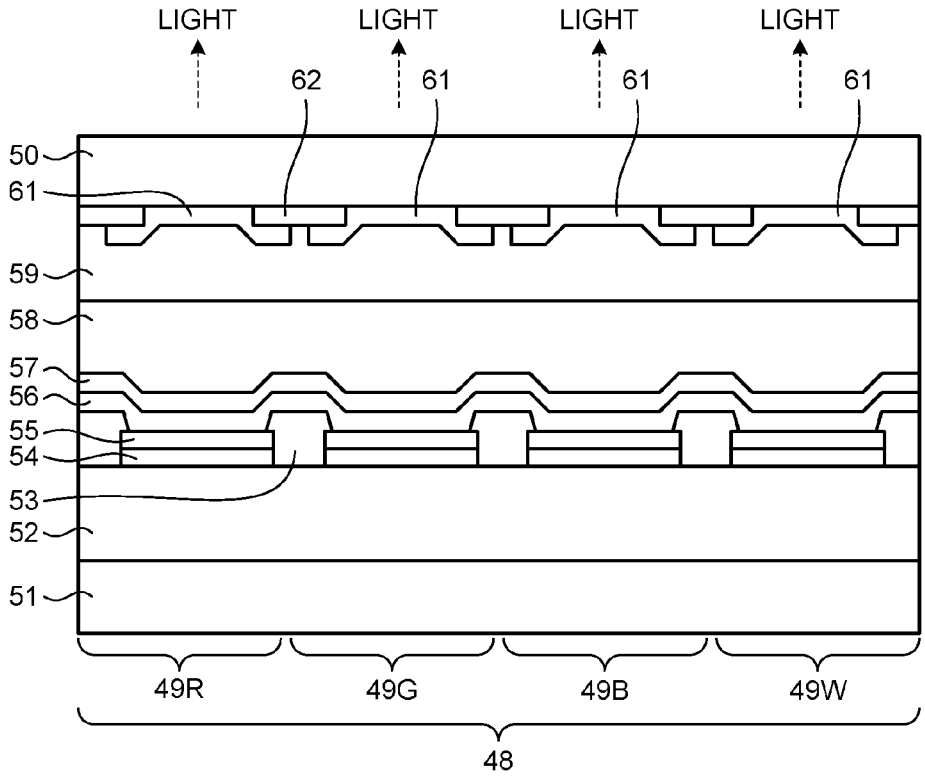
FIG. 4 is a diagram illustrating a cross-sectional structure of the image display panel according to the first embodiment.

First, the following describes the configuration of the image display panel 40. FIG. 2 is a diagram illustrating a lighting drive circuit of a sub-pixel included in a pixel of the image display panel according to the first embodiment. FIG. 3 is a diagram illustrating an array of sub-pixels of the image display panel according to the first embodiment. FIG. 4 is a diagram illustrating a cross-sectional structure of the image display panel according to the first embodiment. As illustrated in FIG. 1, the image display panel 40 includes $P_0 \times Q_0$ ($P_0$ in a row direction, and $Q_0$ in a column direction) pixels 48 arrayed therein in a two-dimensional matrix (rows and columns).

Each pixel 48 includes a plurality of sub-pixels 49, and lighting drive circuits of the sub-pixels 49 illustrated in FIG. 2 are arrayed in a two-dimensional matrix (rows and columns). As illustrated in FIG. 2, the lighting drive circuit includes a control transistor Tr1, a driving transistor Tr2, and a charge holding capacitor CO1. The gate of the control transistor Tr1 is coupled to a scanning line SCL, the source thereof is coupled to a signal line DTL, and the drain thereof is coupled to the gate of the driving transistor Tr2. One end of the charge holding capacitor CO1 is coupled to the gate of the driving transistor Tr2, and the other end thereof is coupled to the source of the driving transistor Tr2. The source of the driving transistor Tr2 is coupled to a power supply line PCL, and the drain of the driving transistor Tr2 is coupled to the anode of an organic light-emitting diode E1 serving as the self-luminous body. The cathode of the organic light-emitting diode E1 is coupled to a reference potential (such as a ground), for example. FIG. 2 illustrates an example in which the control transistor Tr1 is an n-channel transistor, and the driving transistor Tr2 is a p-channel transistor. However, polarities of the respective transistors are not limited thereto. The polarities of the control transistor Tr1 and the driving transistor Tr2 may be determined as needed.

As illustrated in FIG. 3, the pixel 48 includes a first sub-pixel 49R, a second sub-pixel 49G, a third sub-pixel 49B, and a fourth sub-pixel 49W. The first sub-pixel 49R displays a primary color of red as a first color. The second sub-pixel 49G displays a primary color of green as a second color. The third sub-pixel 49B displays a primary color of blue as a third color. The fourth sub-pixel 49W displays white as a fourth color different from the first color, the second color, and the third color. However, the first color, the second color, and the third color are not limited to red, green, and blue, respectively, and an arbitrary color such as a complementary color can be selected as the first color, the second color, and the third color. The fourth color displayed by the fourth sub-pixel 49W is not limited to white, and an arbitrary color can be selected as the fourth color. The fourth color may be the same as the first color, the second color, or the third color. The fourth sub-pixel 49W preferably displays the fourth color of a value (also called as brightness) higher than those of the first sub-pixel 49R, the second sub-pixel 49G, and the third sub-pixel 49B. In this case, the display device 10 can achieve a reduced power consumption. Hereinafter, when it is not necessary to distinguish the first sub-pixel 49R, the second sub-pixel 49G, the third sub-pixel 49B, and the fourth sub-pixel 49W from each other, they are collectively referred to as the sub-pixels 49.

As illustrated in FIG. 4, the image display panel 40 includes a substrate 51, insulating layers 52 and 53, a reflective layer 54, a lower electrode 55, a self-luminous layer 56, an upper electrode 57, an insulating layer 58, an insulating layer 59, a color filter 61 serving as a color conversion layer, a black matrix 62 serving as a light shielding layer, and a substrate 50. The substrate 51 is, for example, a semiconductor substrate made of silicon and the like, a glass substrate, and a resin substrate, and forms or holds the lighting drive circuit described above and the like. The insulating layer 52 is a protective film that protects the lighting drive circuit and the like, and made of a silicon oxide, a silicon nitride, and the like. The lower electrode 55 is provided to each of the first sub-pixel 49R, the second sub-pixel 49G, the third sub-pixel 49B, and the fourth sub-pixel 49W, and is an electric conductor serving as the anode (positive pole) of the organic light-emitting diode E1 described above. The lower electrode 55 is a translucent electrode made of a translucent conductive material (translucent conductive oxide) such as an indium tin oxide (ITO). The insulating layer 53 is called a bank, which is an insulating layer for separating the first sub-pixel 49R, the second sub-pixel 49G, the third sub-pixel 49B, and the fourth sub-pixel 49W from each other. The reflective layer 54 is made of a material, such as silver, aluminum, and gold, having metallic luster that reflects light from the self-luminous layer 56. The self-luminous layer 56 includes an organic material, and includes a hole injection layer, a hole transport layer, a light emitting layer, an electron transport layer, and an electron injection layer that are not illustrated.

Hole Transport Layer

As a layer that generates a positive hole, for example, preferably used is a layer including an aromatic amine compound and a substance that exhibits an electron accepting property to the compound. The aromatic amine compound is a substance having an arylamine skeleton. Among aromatic amine compounds, especially preferred is a compound in which the skeleton includes triphenylamine and the molecular weight of which is 400 or more. Among the aromatic amine compounds in which the skeleton includes triphenylamine, especially preferred is a compound the skeleton of which includes a condensed aromatic ring such as a naphthyl group. Use of the aromatic amine compound that includes triphenylamine and the condensed aromatic ring as the skeleton improves heat resistance of a light-emitting element. Specific examples of the aromatic amine compound include, but are not limited to, 4,4'-bis[N-(1-naphthyl)-N-phenylamino]biphenyl (abbreviated as α-NPD), 4,4'-bis[N-(3-methylphenyl)-N-phenylamino]biphenyl (abbreviated as TPD), 4,4',4"-tris(N,N-diphenylamino)triphenylamine (abbreviated as TDATA), 4,4',4"-tris[N-(3-methylphenyl)-N-phenylamino]triphenylamine (abbreviated as MTDATA), 4,4'-bis[N-{4-(N,N-di-m-tolylamino)phenyl}-N-phenylamino]biphenyl (abbreviated as DNTPD), 1,3,5-tris[N, N-di(m-tolyl)amino]benzene (abbreviated as m-MTDAB), 4,4',4"-tris(N-carbazolyl)triphenylamine (abbreviated as TCTA), 2,3-bis (4-diphenylaminophenyl)quinoxaline (abbreviated as TPAQn), 2,2',3,3'-tetrakis(4-diphenylaminophenyl)-6,6'-bisquinoxaline (abbreviated as D-TriPhAQn), 2,3-bis{4-[N-(1-naphthyl)-N-phenylamino]phenyl}-dibenzo[f,h]quinoxaline (abbreviated as NPADiBzQn), etc. The substance that exhibits the electron accepting property to the aromatic amine compound is not specifically limited. Examples of this substance may include, but are not limited to, a molybdenum oxide, a vanadium oxide, 7,7,8,8-tetracyanoquinodimethane (abbreviated as TCNQ), 2,3,5,6-tetrafluoro-7,7,8,8-tetracyanoquinodimethane (abbreviated as F4-TCNQ), etc.

Electron Injection Layer and Electron Transport Layer

An electron transport substance is not specifically limited. Examples of the electron transport substance may include, but are not limited to, a metal complex such as tris(8-quinolinolato)aluminum (abbreviated as Alq3), tris(4-methyl-8-quinolinolato)aluminum (abbreviated as Almq3), bis(10-hydroxybenzo[h]-quinolinolato)beryllium (abbreviated as BeBq2), bis(2-methyl-8-quinolinolato)-4-phenylphenolate-aluminum (abbreviated as BAlq), bis[2-(2-hydroxyphenyl)benzoxazolato]zinc (abbreviated as Zn(BOX)2), and bis[2-(2-hydroxyphenyl)benzothiazolato]zinc (abbreviated as Zn(BTZ)2). The examples of the electron transport substance may also include 2-(4-biphenylyl)-5-(4-tert-butylphenyl)-1,3,4-oxadiazole (abbreviated as PBD), 1,3-bis[5-(p-tert-butylphenyl)-1,3,4-oxadiazole-2-yl]benzene (abbreviated as OXD-7), 3-(4-tert-butylphenyl)-4-phenyl-5-(4-biphenylyl)-1,2,4-triazole (abbreviated as TAZ), 3-(4-tert-butylphenyl)-4-(4-ethylphenyl)-5-(4-biphenylyl)-1,2,4-triazole (abbreviated as p-EtTAZ), bathophenanthroline (abbreviated as BPhen), bathocuproin (abbreviated as BCP), etc. A substance that exhibits an electron donating property to the electron transport substance is not specifically limited. Examples of the substance may include, but are not limited to, an alkali metal such as lithium and cesium, an alkaline-earth metal such as magnesium and calcium, a rare earth metal such as erbium and ytterbium, etc. A substance selected from among alkali metal oxides and alkaline-earth metal oxides such as a lithium oxide (Li2O), a calcium oxide (CaO), a sodium oxide (Na2O), a potassium oxide (K2O), and a magnesium oxide (MgO) may be used as the substance that exhibits the electron donating property to the electron transport substance.

Light Emitting Layer

For example, to obtain red-based light emission, a substance exhibiting light emission that has the peak of emission spectrum in a range from 600 nm to 680 nm may be used such as 4-dicyanomethylene-2-isopropyl-6-[2-(1,1,7,7-tetramethyljulolidine-9-yl)ethenyl]-4H-pyrane (abbreviated as DCJTI), 4-dicyanomethylene-2-methyl-6-[2-(1,1,7,7-tetramethyljulolidine-9-yl)ethenyl]-4H-pyrane (abbreviated as DCJT), 4-dicyanomethylene-2-tert-butyl-6-[2-(1,1,7,7-tetramethyljulolidine-9-yl)ethenyl]-4H-pyrane (abbreviated as DCJTB), periflanthene, and 2,5-dicyano-1,4-bis[2-(10-methoxy-1,1,7,7-tetramethyljulolidine-9-yl)ethenyl]benzene. To obtain green-based light emission, a substance exhibiting light emission that has the peak of emission spectrum in a range from 500 nm to 550 nm may be used such as N,N'-dimethylquinacridone (abbreviated as DMQd), coumarin 6, coumarin 545T, and tris(8-quinolinolato)aluminum (abbreviated as Alq3). To obtain blue-based light emission, a substance exhibiting light emission that has the peak of emission spectrum in a range from 420 nm to 500 nm may be used such as 9,10-bis(2-naphthyl)-tert-butylanthracene (abbreviated as t-BuDNA), 9,9'-bianthryl, 9,10-diphenylanthracene (abbreviated as DPA), 9,10-bis(2-naphthyl)anthracene (abbreviated as DNA), bis(2-methyl-8-quinolinolato)-4-phenylphenolate-gallium (abbreviated as BGaq), and bis(2-methyl-8-quinolinolato)-4-phenylphenolate-aluminum (abbreviated as BAlq). As described above, in addition to the substance that emits fluorescent light, a substance that emits phosphorescent light may be used as the light-emitting substance such as bis[2-(3,5-bis(trifluoromethyl)phenyl)pyridinato-N,C2']iridium (III) picolinate (abbreviated as Ir(CF3ppy)2(pic)), bis[2-(4,6-difluorophenyl)pyridinato-N,C2']iridium (III) acetylacetonate (abbreviated as FIr(acac)), bis[2-(4,6-difluorophenyl)pyridinato-N,C2']iridium (III) picolinate (abbreviated as FIr(pic)), and tris(2-phenylpyridinato-N,C2')iridium (abbreviated as Ir(ppy)3).

The upper electrode 57 is a translucent electrode made of a translucent conductive material (translucent conductive oxide) such as an indium tin oxide (ITO). In this embodiment, the ITO is exemplified as the translucent conductive material. However, the translucent conductive material is not limited thereto. As the translucent conductive material, a conductive material having different composition such as an indium zinc oxide (IZO) may be used. The upper electrode 57 is the cathode (negative pole) of the organic light-emitting diode E1. The insulating layer 58 is a sealing layer that seals the upper electrode, and may be made of a silicon oxide, a silicon nitride, and the like. The insulating layer 59 is a planarization layer that prevents a level difference due to the bank, and may be made of a silicon oxide, a silicon nitride, and the like. The substrate 50 is a translucent substrate that protects the entire image display panel 40, and may be a glass substrate, for example. FIG. 4 illustrates an example in which the lower electrode 55 is the anode (positive pole) and the upper electrode 57 is the cathode (negative pole). However, the embodiment is not limited thereto. The lower electrode 55 may be the cathode and the upper electrode 57 may be the anode. In this case, the polarity of the driving transistor Tr2 that is electrically coupled to the lower electrode 55 can be appropriately changed, and a stacking order of the carrier injection layer (the hole injection layer and the electron injection layer), the carrier transport layer (the hole transport layer and the electron transport layer), and the light emitting layer can be appropriately changed.

The image display panel 40 is a color display panel in which the color filter 61 for transmitting light of a color corresponding to the color of the sub-pixel 49 among components of light emitted from the self-luminous layer 56 is arranged between the sub-pixel 49 and an image observer. The image display panel 40 can emit light of colors corresponding to red, green, blue, and white. The color filter 61 is not necessarily arranged between the fourth sub-pixel 49W corresponding to white and the image observer. In the image display panel 40, the components of light emitted from the self-luminous layer 56 can be of colors of the first sub-pixel 49R, the second sub-pixel 49G, the third sub-pixel 49B, and the fourth sub-pixel 49W without using the color conversion layer such as the color filter 61. For example, in the image display panel 40, a transparent resin layer may be provided to the fourth sub-pixel 49W in place of the color filter 61 for color adjustment. In this way, by providing the transparent resin layer, the image display panel 40 can prevent a large level difference in the fourth sub-pixel 49W.

Figure 5:
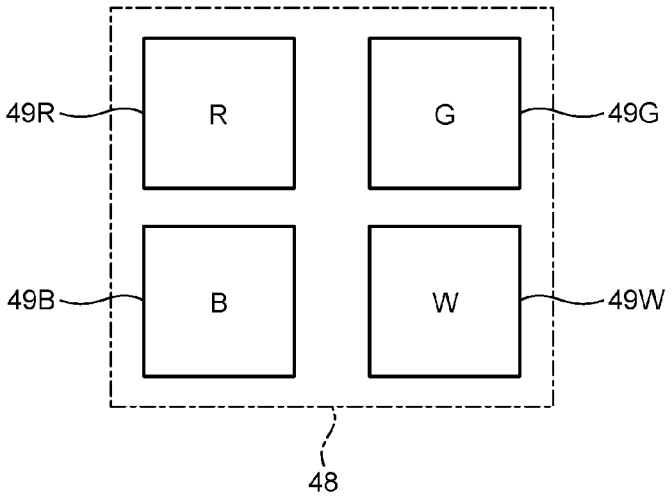
FIG. 5 is a diagram illustrating another array of sub-pixels of the image display panel according to the first embodiment.

FIG. 5 is a diagram illustrating another array of sub-pixels of the image display panel according to the first embodiment. In the image display panel 40, the pixels 48 are arranged in a matrix, the pixels 48 each including an array of two rows and two columns of sub-pixels 49 including the first sub-pixel 49R, the second sub-pixel 49G, the third sub-pixel 49B, and the fourth sub-pixel 49W. In this way, in the image display panel 40, the array of the sub-pixels 49 in the pixel 48 may be arbitrarily set. As described above, the image display panel 40 is an organic light-emitting diode (OLED) type image display panel. However, the embodiment is not limited thereto. For example, the image display panel 40 may be a liquid crystal display panel.

Configuration of Signal Processing Unit

The following describes the signal processing unit 20. The signal processing unit 20 processes an input signal input from the control device 11 to generate an output signal. The signal processing unit 20 performs expansion processing on input signals to the first sub-pixel 49R, the second sub-pixel 49G, and the third sub-pixel 49B, and generates input expansion signals for the first sub-pixel 49R, the second sub-pixel 49G, and the third sub-pixel 49B corresponding to colors that can be expressed in an expanded color space. The signal processing unit 20 then generates output signals for the first sub-pixel 49R, the second sub-pixel 49G, the third sub-pixel 49B, and the fourth sub-pixel 49W from the input expansion signals for the first sub-pixel 49R, the second sub-pixel 49G, and the third sub-pixel 49B. The signal processing unit 20 outputs the generated output signals to the image display panel driving unit 30. The expanded color space will be described later. In the first embodiment, the expanded color space is an HSV (Hue-Saturation-Value, Value is also called Brightness) color space. However, the embodiment is not limited thereto. The expanded color space may be an XYZ color space, a YUV space, or another coordinate system.

Figure 6:
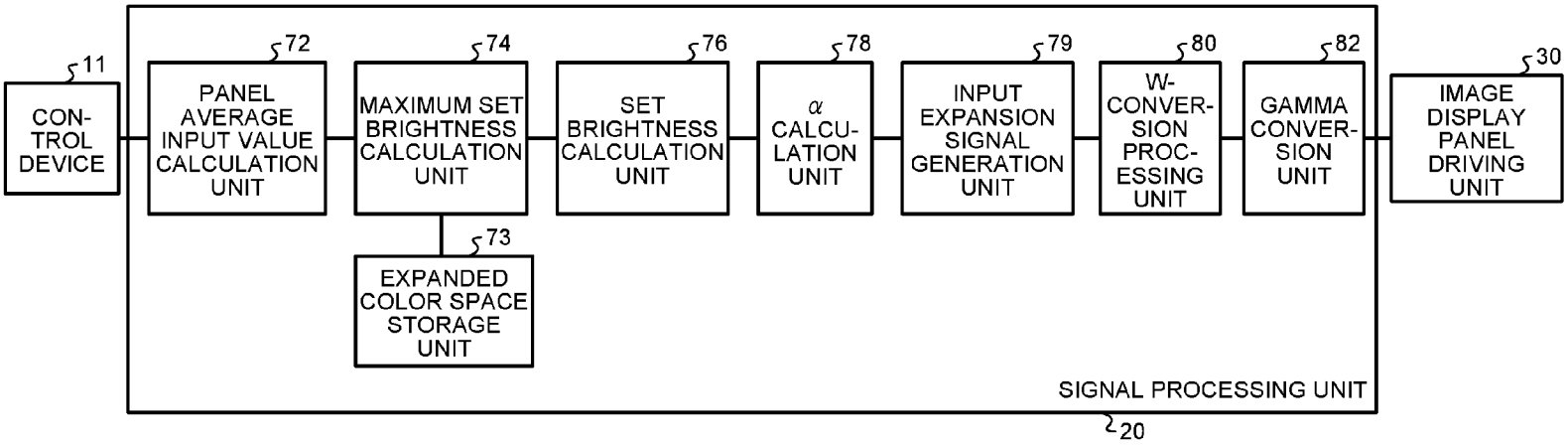
FIG. 6 is a schematic block diagram illustrating the configuration of a signal processing unit according to the first embodiment.

FIG. 6 is a schematic block diagram illustrating the configuration of the signal processing unit according to the first embodiment. As illustrated in FIG. 6, the signal processing unit 20 includes a panel average input value calculation unit 72, an expanded color space storage unit 73, a maximum set brightness calculation unit 74, a set brightness calculation unit 76, an a calculation unit 78, an input expansion signal generation unit 79, a W-conversion processing unit 80, and a gamma conversion unit 82. The signal processing unit 20 is electrically coupled to the image display panel driving unit 30.

The panel average input value calculation unit 72 receives an input signal to each pixel 48 from the control device 11. The input signal is a signal that has a gradation signal value of each of red (first color), green (second color), and blue (third color), and causes each pixel 48 to display a specified color by combining these gradation signal values. The panel average input value calculation unit 72 receives the input signals of all of the pixels 48 within one frame, that is, all the input signals of all of the pixels 48 within the image display panel 40, which is an image displayed within one frame. The panel average input value calculation unit 72 calculates a panel average input value that is an average value of the gradation signal values of the input signals of all of the pixels 48 within one frame. The panel average input value calculation unit 72 outputs the input signal of each pixel 48 and the panel average input value to the maximum set brightness calculation unit 74. Processing of calculating the panel average input value performed by the panel average input value calculation unit 72 will be described later in detail. The panel average input value calculation unit 72 calculates, from the input signal of each pixel 48, a hue, saturation, and brightness in a case of displaying the color based on the input signal.

The expanded color space storage unit 73 stores the expanded color space. For example, the expanded color space storage unit 73 stores, for each saturation, an upper limit value of the brightness that can be extended in the expanded color space. The expanded color space is, for example, a color space that is extended with red (first color), green (second color), blue (third color), and white (fourth color), and represents a range of the color that can be displayed by the image display panel 40. The expanded color space will be described later in detail.

The maximum set brightness calculation unit 74 receives the input signal and the panel average input value input from the panel average input value calculation unit 72. The maximum set brightness calculation unit 74 reads out data of the expanded color space from the expanded color space storage unit 73. The maximum set brightness calculation unit 74 calculates, from the data of the expanded color space and the panel average input value, a maximum set brightness for all of the pixels 48 in one frame, that is an upper limit value of the brightness of the color to be displayed. The maximum set brightness calculation unit 74 determines the maximum set brightness so that the maximum set brightness is within a range of the brightness that can be extended in the expanded color space, and so that the maximum set brightness increases as the panel average input value decreases. The maximum set brightness calculation unit 74 outputs a calculated value of the maximum set brightness and the input signal to the set brightness calculation unit 76. Processing of calculating the maximum set brightness performed by the maximum set brightness calculation unit 74 will be described later in detail.

The set brightness calculation unit 76 receives the input signal and the maximum set brightness input from the maximum set brightness calculation unit 74. The set brightness calculation unit 76 calculates a set brightness based on the input value of the input signal and the value of the maximum set brightness. The set brightness is the brightness of the color to be displayed by the pixel 48. The set brightness calculation unit 76 stores a calculation expression for calculating the set brightness based on the signal value of the input signal and the maximum set brightness. The set brightness calculation unit 76 calculates the set brightness so that the set brightness increases up to the maximum set brightness as the input value of the input signal to the pixel 48 increases. The set brightness calculation unit 76 outputs the calculated set brightness and the input signal to the α calculation unit 78. Processing of calculating the set brightness performed by the set brightness calculation unit 76 will be described later in detail.

The α calculation unit 78 receives the input signal and the set brightness input from the set brightness calculation unit 76. The α calculation unit 78 compares the set brightness with the brightness of the color displayed based on the input value of the input signal to calculate an input expansion coefficient for expanding the color displayed based on the input signal to a color corresponding to the set brightness. The α calculation unit 78 outputs the calculated input expansion coefficient and the input signal to the input expansion signal generation unit 79. The set brightness increases up to the maximum set brightness as the input value of the input signal increases. In other words, the input expansion coefficient is used for expanding the color displayed based on the input value of the input signal to a color corresponding to the maximum set brightness. Processing of calculating the input expansion coefficient performed by the α calculation unit 78 will be described later in detail.

The input expansion signal generation unit 79 receives the input expansion coefficient and the input signal input from the α calculation unit 78. The input expansion signal generation unit 79 expands the signal value of the input signal with the input expansion coefficient to generate the input expansion signal of each pixel 48. The input expansion signal is a signal having a signal value obtained by expanding the color displayed based on the input value of the input signal to the color corresponding to the set brightness. The input expansion signal generation unit 79 outputs the input expansion signal to the W-conversion processing unit 80. Processing of generating the input expansion signal will be described later in detail.

The W-conversion processing unit 80 receives the input expansion signal input from the input expansion signal generation unit 79. The W-conversion processing unit 80 converts, for example, input expansion signal values as the gradation signal values obtained by expanding red (first color), green (second color), and blue (third color) into an output signal having the gradation signal values of red (first color), green (second color), blue (third color), and white (fourth color). The W-conversion processing unit 80 outputs the generated output signal to the gamma conversion unit 82. Processing of generating the output signal performed by the W-conversion processing unit 80 will be described later in detail.

The gamma conversion unit 82 receives an output signal value input from each pixel 48. The gamma conversion unit 82 performs gamma conversion on the output signal value of each pixel 48 to generate an image output signal having predetermined electric potential for displaying the color corresponding to the output signal value, and outputs the image output signal to the image display panel driving unit 30.

Configuration of Image Display Panel Driving Unit

The image display panel driving unit 30 is a control device for the image display panel 40, and includes a signal output circuit 31, a scanning circuit 32, and a power supply circuit 33. The signal output circuit 31 is electrically coupled to the image display panel 40 via the signal line DTL. The signal output circuit 31 holds an input image output signal, and successively outputs an image output signal to each sub-pixel 49 of the image display panel 40. The scanning circuit 32 is electrically coupled to the image display panel 40 via the scanning line SCL. The scanning circuit 32 selects the sub-pixel 49 in the image display panel 40, and controls ON/OFF of a switching element (for example, a thin film transistor (TFT)) for controlling an operation (light transmittance) of the sub-pixel 49. The power supply circuit 33 supplies electric power to the organic light-emitting diode E1 of each sub-pixel 49 via the power supply line PCL.

Expanded Color Space

The following describes the expanded color space. First, a standard color space is described. Hereinafter, the standard color space according to the first embodiment is referred to as a standard color space 100, and the expanded color space according to the first embodiment is referred to as an expanded color space 110. The standard color space 100 is, for example, a color space representing a range of the color that can be extended with red (first color), green (second color), and blue (third color). That is, the standard color space 100 is a color space of the color that can be displayed based on the input value of an input signal. The standard color space 100 is the HSV color space. However, the embodiment is not limited thereto. The standard color space 100 may be the XYZ color space, the YUV space, or another coordinate system.

The expanded color space 110 is, for example, a color space representing a range of the color that can be extended with red (first color), green (second color), blue (third color), and white (fourth color). That is, the expanded color space 110 is a color space of the color that can be displayed based on the output signal obtained by expanding and converting input signals into the gradation signal values of red (first color), green (second color), blue (third color), and white (fourth color), for example.

Figure 7:
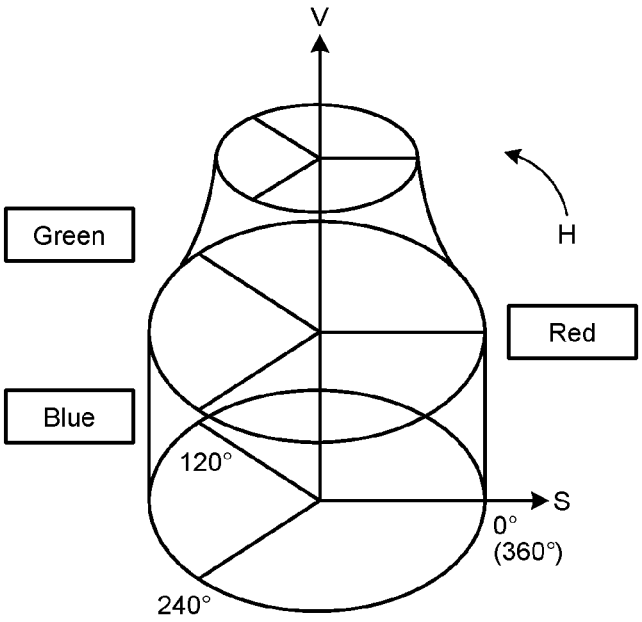
FIG. 7 is a conceptual diagram of an expanded color space.
Figure 8:
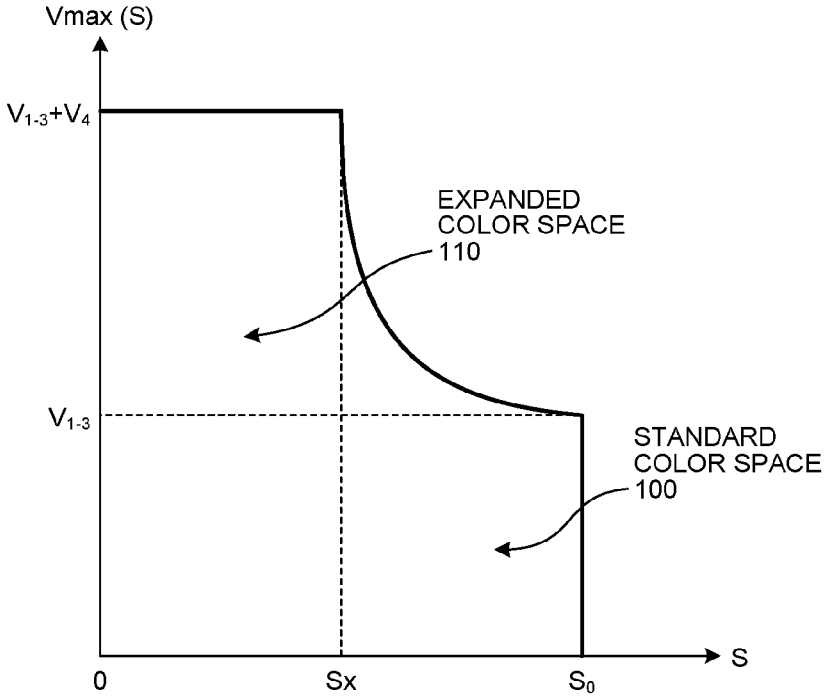
FIG. 8 is a conceptual diagram illustrating a relation between a saturation and a brightness in the expanded color space.

FIG. 7 is a conceptual diagram of the expanded color space. FIG. 8 is a conceptual diagram illustrating a relation between the saturation and the brightness in the expanded color space. A horizontal axis illustrated in FIG. 7 and FIG. 8 indicates the saturation (S), a vertical axis indicates the brightness (V), and a circumferential axis along a circumferential direction centered around the vertical axis indicates the hue (H). The hue H is represented in a range from 0° to 360° as illustrated in FIG. 7. From 0° toward 360°, the hue H changes from red to yellow, green, cyan, blue, magenta, and back to red. In the first embodiment, a region including angles 0° and 360° is red, a region including the angle 120° is green, and a region including the angle 240° is blue. FIG. 8 is a cross-sectional view of the expanded color space 110 in FIG. 7 cut along a cross section orthogonal to a tangential direction of the circumferential axis. Accordingly, FIG. 8 illustrates a relation between the saturation and the brightness in an arbitrary hue in the expanded color space. The relation between the saturation and the brightness in the standard color space remains the same irrespective of the hue.

As illustrated in FIG. 8, the standard color space 100 is a cylindrical HSV color space. The expanded color space 110 has a shape obtained by placing a substantially trapezoidal space on the cylindrical standard color space 100, the trapezoidal space being extendable with the fourth sub-pixel 49W in which the maximum value of the brightness V decreases as the saturation S increases. The upper limit value of the brightness that can be extended in the standard color space 100 is defined as a maximum brightness $V_{1-3}$. A displayable upper limit value of the brightness of white (fourth color) by the fourth sub-pixel 49W is defined as a fourth sub-pixel maximum brightness $V_4$. The expanded color space 110 is obtained by adding a substantially trapezoidal color space in which the maximum brightness is the fourth sub-pixel maximum brightness $V_4$ to the cylindrical HSV color space in which the upper limit value of the brightness that can be extended in a range of the saturation from 0 to the maximum value $S_0$ (maximum brightness) is the maximum brightness $V_{1-3}$. When the maximum brightness in the expanded color space at the saturation S is defined as an expanded color space maximum brightness Vmax(S), the expanded color space maximum brightness Vmax(S) is $V_{1-3}+V_4$ in a range of the saturation from 0 to Sx. The expanded color space maximum brightness Vmax (S) decreases as the saturation increases from Sx to $S_0$, and becomes $V_{1-3}$ at the saturation $S_0$. The saturation Sx is the upper limit value of the saturation in a case in which the expanded color space maximum brightness Vmax(S) is a maximum brightness of $V_{1-3}+V_4$ as the maximum value. The saturation Sx is a predetermined value that depends on an element characteristic of the fourth sub-pixel 49W. The expanded color space maximum brightness Vmax(S) in a range of the saturation from Sx to $S_0$ also depends on the element characteristic of the fourth sub-pixel 49W. Details thereof will be described later. FIG. 7 illustrates the shape of the expanded color space in a case in which the color of the fourth sub-pixel is white. When the color of the fourth sub-pixel is other than white, the shape of the expanded color space is different from that illustrated in FIG. 7.

The display device 10 generates an input expansion signal by expanding an input signal and generates an output signal from the input expansion signal to widen an extensible color space from the standard color space 100 to the expanded color space 110, and displays a color.

Processing of Generating Input Expansion Signal

The following describes the processing of generating the input expansion signal performed by the signal processing unit 20. The signal processing unit 20 receives the input signal as information of an image to be displayed input from the control device 11. The input signal includes information of the image (color) displayed at the position of each pixel. Specifically, for the (p, q)-th pixel (where $1 \le p \le P_0$, $1 \le q \le Q_0$), signals including the input signal of the first sub-pixel having a signal value of $x_{1-(p,\ q)}$, the input signal of the second sub-pixel having a signal value of $x_{2-(p,\ q)}$, and the input signal of the third sub-pixel having a signal value of $x_{3-(p,\ q)}$ are input to the signal processing unit 20. The signal processing unit 20 expands these input signals to generate the input expansion signal of the first sub-pixel 49R (signal value $xA_{1-(p,\ q)}$), the input expansion signal of the second sub-pixel 49G (signal value $xA_{2-(p,\ q)}$), and the input expansion signal of the third sub-pixel 49B (signal value $xA_{3-(p,\ q)}$).

First, the signal processing unit 20 calculates the panel average input value that is an average signal value of the input signals of all of the pixels 48 within one frame, using the panel average input value calculation unit 72. When the average input value of the sub-pixels 49 in one pixel 48 is defined as $I_{AV(p,\ q)}$ and the panel average input value of all of the pixels 48 within one frame is defined as $I_{AV}$, the signal processing unit 20 calculates a panel average input value $I_{AV}$ based on the following expressions (1) and (2). The signal processing unit 20 calculates the panel average input value $I_{AV}$ as a value common to all of the pixels 48 within one frame.

$$I_{AV(p,q)} = \frac{X_{1-(p,q)} + X_{2-(p,q)} + X_{3-(p,q)}}{3} \tag{1}$$

$$I_{AV} = \frac{\sum_{p,q=1,1}^{P_0,Q_0} X(I_{AV(p,q)})}{P_0 \times Q_0} \tag{2}$$

The input signal value $x_{1-(p,\ q)}$ of the first sub-pixel, the input signal value $x_{2-(p,\ q)}$ of the second sub-pixel, and the input signal value $x_{3-(p,\ q)}$ of the third sub-pixel can be any value in a range from 0 to $(2^n-1)$ where n represents a display gradation bit number. In the first embodiment, n is 8, therefore each of the input signal value $x_{1-(p,\ q)}$ of the first sub-pixel, the input signal value $x_{2-(p,\ q)}$ of the second sub-pixel, and the input signal value $x_{3-(p,\ q)}$ of the third sub-pixel is an integer value of 0 to 255. Thus, the panel average input value $I_{AV}$ is also the integer value of 0 to 255, but is not limited to the integer value. A method of calculating the panel average input value $I_{AV}$ is not limited to the expressions (1) and (2) so long as the panel average input value $I_{AV}$ is the average signal value of the input signals of all of the pixels 48 within one frame.

Next, the signal processing unit 20 calculates the maximum set brightness of all of the pixels 48 within one frame based on the panel average input value $I_{AV}$ and the data of the expanded color space, using the maximum set brightness calculation unit 74. More specifically, the maximum set brightness calculation unit 74 sets the maximum set brightness to be in a range of the brightness that can be extended in the expanded color space and cannot be extended in the standard color space, that is, in a range between the maximum brightness $V_{1-3}$ and the maximum brightness $V_{1-3}+V_4$. The maximum set brightness calculation unit 74 also determines the maximum set brightness so that the maximum set brightness increases as the panel average input value $I_{AV}$ decreases. The maximum set brightness calculation unit 74 calculates the maximum set brightness as a value common to all of the pixels 48 within one frame.

Figure 9:
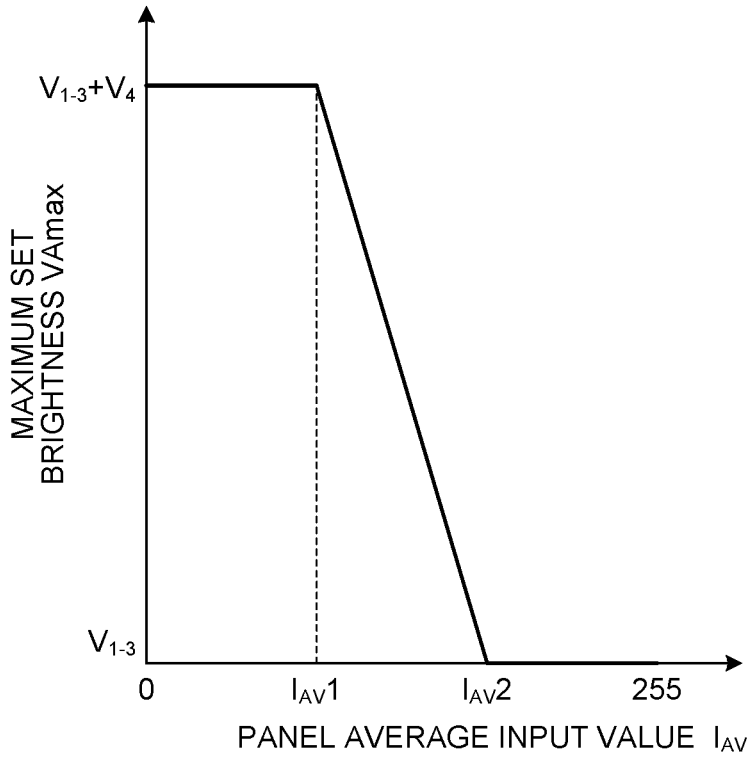
FIG. 9 is a graph illustrating an example of a relation between a panel average input value and a maximum set brightness.

FIG. 9 is a graph illustrating an example of a relation between the panel average input value and the maximum set brightness. Specifically, the maximum set brightness calculation unit 74 reads out the expanded color space maximum brightness Vmax(S) (in this case, the maximum brightnesses $V_{1-3}$ and $V_{1-3}+V_4$) from the expanded color space storage unit 73. The panel average input value $I_{AV}1$ is set to be a predetermined value equal to or larger than 0 (a lower limit value of the panel average input value $I_{AV}$) and smaller than 255 (an upper limit value of the panel average input value $I_{AV}$). The panel average input value $I_{AV}2$ is set to be a predetermined value larger than the panel average input value $I_{AV}1$ and equal to or smaller than 255 (the upper limit value of the panel average input value $I_{AV}$). The calculated maximum set brightness is defined as the maximum set brightness VAmax.

As illustrated in FIG. 9, when the panel average input value $I_{AV}$ is $I_{AV}2$ to 255, the maximum set brightness calculation unit 74 sets the value of the maximum set brightness VAmax to be the maximum brightness $V_{1-3}$. When the panel average input value $I_{AV}$ is 0 to $I_{AV}1$, the maximum set brightness calculation unit 74 sets the value of the maximum set brightness VAmax to be the maximum brightness $V_{1-3}+V_4$. As the panel average input value $I_{AV}$ decreases from $I_{AV}2$ toward $I_{AV}1$, the maximum set brightness calculation unit 74 sets the value of the maximum set brightness VAmax to increase from the maximum brightness $V_{1-3}$ toward the maximum brightness $V_{1-3}+V_4$. Specifically, the maximum set brightness calculation unit 74 calculates the maximum set brightness VAmax based on the following expression (3).

$$\left\{\begin{array}{ll} \mathrm{VA\ max} = V_4 & \text{if } I_{AV} \le I_{AV}1 \\ \mathrm{VA\ max} = V_4 - \dfrac{(V_4 - V_{1-3})}{(I_{AV}2 - I_{AV}1)} \cdot (I_{AV} - I_{AV}1) & \text{if } I_{AV}1 < I_{AV} < I_{AV}2 \\ \mathrm{VA\ max} = V_{1-3} & \text{if } I_{AV}2 \le I_{AV} \end{array}\right\} \quad (3)$$

The maximum set brightness calculation unit 74 sets the value of the maximum set brightness VAmax to linearly increase as the panel average input value $I_{AV}$ decreases from $I_{AV}2$ toward $I_{AV}1$. However, the embodiment is not limited thereto. For example, the maximum set brightness calculation unit 74 may set the value of the maximum set brightness VAmax to increase quadratically as the panel average input value $I_{AV}$ decreases. Any method can be used to determine the maximum set brightness VAmax so long as the maximum set brightness calculation unit 74 determines the maximum set brightness VAmax so that the maximum set brightness VAmax increases as the panel average input value $I_{AV}$ decreases.

In calculating the maximum set brightness VAmax, the maximum set brightness calculation unit 74 may calculate the panel average input value $I_{AV}$ using luminance of the pixel 48. The luminance of the (p, q)-th pixel 48 is represented by the following expression (4) when the luminance is represented by $L_{(p,\ q)}$.

$$L_{(p,q)}=0.3\cdot x_{1-(p,q)}+0.6\cdot x_{2-(p,q)}+0.1\cdot x_{3-(p,q)} \quad (4)$$

In this case, the panel average input value $I_{AV}$ is calculated by replacing the average input value $I_{AV(p,\ q)}$ with the luminance $L_{(p,\ q)}$ in the above expression (2). However, the calculation expression of the luminance $L_{(p,\ q)}$ is merely an example. The calculation may be performed in an arbitrary manner using the input signal value $x_{1-(p,\ q)}$ of the first sub-pixel, the input signal value $x_{2-(p,\ q)}$ of the second sub-pixel, and the input signal value $x_{3-(p,\ q)}$ of the third sub-pixel.

Next, the signal processing unit 20 calculates the set brightness of each pixel 48 based on the input signal and the value of the maximum set brightness VAmax using the set brightness calculation unit 76. The set brightness is the brightness of the color displayed by the pixel 48 when the input signal is expanded, in other words, the brightness of the color displayed based on the input expansion signal. The set brightness calculation unit 76 calculates the set brightness so that the set brightness increases up to the maximum set brightness VAmax as the input value of the input signal to the pixel 48 increases.

Figure 10:
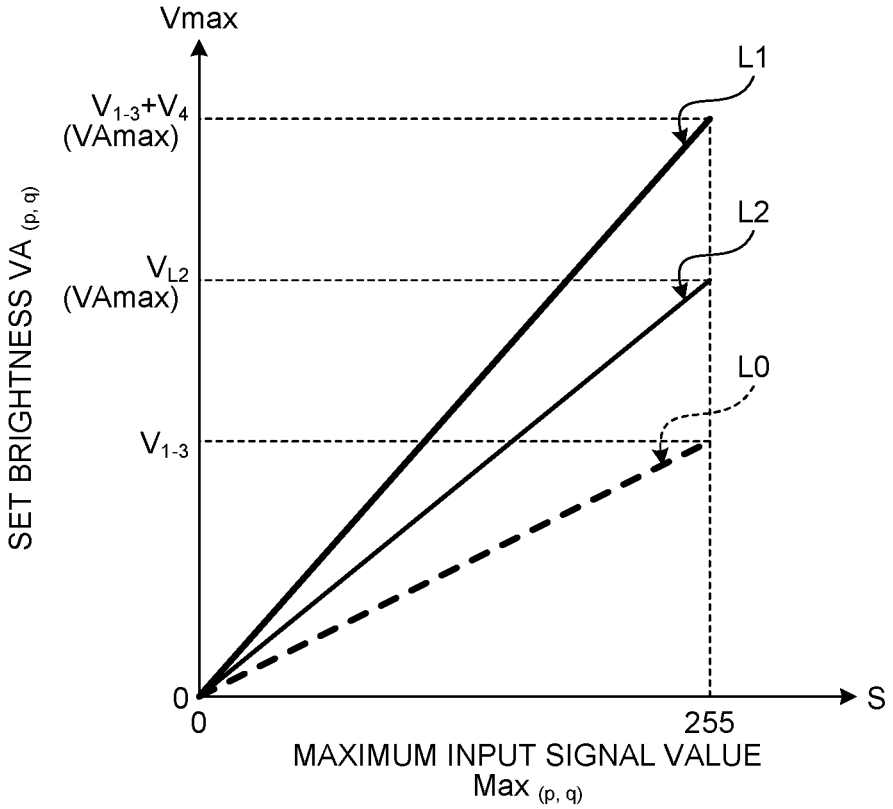
FIG. 10 is a graph illustrating an example of a relation between a signal value of an input signal and a set brightness.

FIG. 10 is a graph illustrating an example of a relation between the signal value of the input signal and the set brightness. The horizontal axis in FIG. 10 indicates a maximum input signal value $Max_{(p,\ q)}$ as a maximum value of the input signal of the pixel 48. The maximum input signal value $Max_{(p,\ q)}$ is the maximum value among the input signal values of three sub-pixels 49, that is, ($x_{1-(p,\ q)}$, $x_{2-(p,\ q)}$, $x_{3-(p,\ q)}$). The vertical axis in FIG. 10 indicates a set brightness $VA_{(p,\ q)}$.

A line segment L0 in FIG. 10 represents a relation between the maximum input signal value $Max_{(p,\ q)}$ and the brightness $V(S)_{(p,\ q)}$ of the color displayed based on the input signal. In other words, the line segment L0 represents the brightness of the color in a case in which the color is displayed without expanding the input signal. The brightness $V(S)_{(p,\ q)}$ is calculated by the panel average input value calculation unit 72 based on the following expression (5). Accordingly, as represented by the line segment L0, in a case in which the expansion processing is not performed, the brightness $V(S)_{(p,\ q)}$ is 0 when the maximum input signal value $Max_{(p,\ q)}$ is 0, and the brightness $V(S)_{(p,\ q)}$ is $V_{1-3}$ (in this case, 255) when the maximum input signal value $Max_{(p,\ q)}$ is 255.

$$V(S)_{(p,q)}=\mathrm{Max}_{(p,q)} \quad (5)$$

A line segment L1 in FIG. 10 represents a relation between the maximum input signal value $Max_{(p,\ q)}$ and the set brightness $VA_{(p,\ q)}$ in a case in which the maximum set brightness VAmax is the maximum brightness $V_{1-3}+V_4$. As represented by the line segment L1, when the maximum input signal value $Max_{(p,\ q)}$ is 0, the set brightness calculation unit 76 sets the set brightness $VA_{(p,\ q)}$ to be 0. When the maximum input signal value $Max_{(p,\ q)}$ is 255, the set brightness calculation unit 76 sets the set brightness $VA_{(p,\ q)}$ to be the maximum set brightness VAmax (in this case, the maximum brightness $V_{1-3}+V_4$). The set brightness calculation unit 76 then sets the set brightness $VA_{(p,\ q)}$ so that the set brightness $VA_{(p,\ q)}$ increases as the maximum input signal value $Max_{(p,\ q)}$ increases.

A line segment L2 in FIG. 10 represents a relation between the maximum input signal value $Max_{(p,\ q)}$ and the set brightness $VA_{(p,\ q)}$ in a case in which the maximum set brightness VAmax is $V_{L2}$. As represented by the line segment L2, when the maximum input signal value $Max_{(p, q)}$ is 0, the set brightness calculation unit 76 sets the set brightness $VA_{(p, q)}$ to be 0. When the maximum input signal value $Max_{(p, q)}$ is 255, the set brightness calculation unit 76 sets the set brightness $VA_{(p, q)}$ to be the maximum set brightness VAmax (in this case, the maximum brightness $V_{L2}$).

Specifically, the set brightness calculation unit 76 stores the relation between the maximum input signal value $Max_{(p, q)}$ and the set brightness $VA_{(p, q)}$ (set brightness data) as represented by the following expression (6).

$$VA_{(p,q)}=(VA\max/V_{1\text{-}3})\cdot Max_{(p,q)} \quad (6)$$

The set brightness calculation unit 76 calculates the set brightness $VA_{(p, q)}$ for each pixel 48 within one frame according to the expression (6). The values of the maximum set brightness VAmax and the maximum brightness $V_{1\text{-}3}$ in the expression (6) are common to all of the pixels 48 within one frame. Thus, a relation between the signal value of the input signal and the set brightness $VA_{(p, q)}$ is common to all of the pixels 48 within one frame. The method of calculating the set brightness $VA_{(p, q)}$ (set brightness data) is not limited to the expression (6) so long as the set brightness calculation unit 76 sets the set brightness $VA_{(p, q)}$ so that the set brightness $VA_{(p, q)}$ increases up to the maximum set brightness VAmax as the maximum input signal value $Max_{(p, q)}$ increases.

The method of calculating the set brightness $VA_{(p, q)}$ illustrated in FIG. 10 and represented by the expression (6) is applied when the value of the saturation of the pixel 48 calculated based on the input signal is 0 to Sx. As described above, the maximum brightness that can be displayed in the expanded color space 110 varies with the saturation. As illustrated in FIG. 8, when the saturation is in a range from 0 to Sx, the maximum brightness that can be displayed in the expanded color space 110 is the maximum brightness $V_{1\text{-}3}+V_4$. When the saturation is equal to or larger than Sx, the maximum brightness that can be displayed in the expanded color space 110 is smaller than the maximum brightness $V_{1\text{-}3}+V_4$. Accordingly, in each pixel 48 within one frame, even when the maximum input signal value $Max_{(p, q)}$ and the maximum set brightness VAmax are the same, the set brightness $VA_{(p, q)}$ may be different because a saturation $S_{(p, q)}$ calculated based on the input signal is different. The saturation $S_{(p, q)}$ based on the input signal is calculated by the panel average input value calculation unit 72 using the following expression (7).

$$S_{(p,q)}=(Max_{(p,q)}-Min_{(p,q)})/Max_{(p,q)} \quad (7)$$

In this case, $Min_{(p, q)}$ is the minimum value among the input signal values of three sub-pixels 49, that is, ($x_{1\text{-}(p, q)}$, $x_{2\text{-}(p, q)}$, $x_{3\text{-}(p, q)}$.

Figure 11:
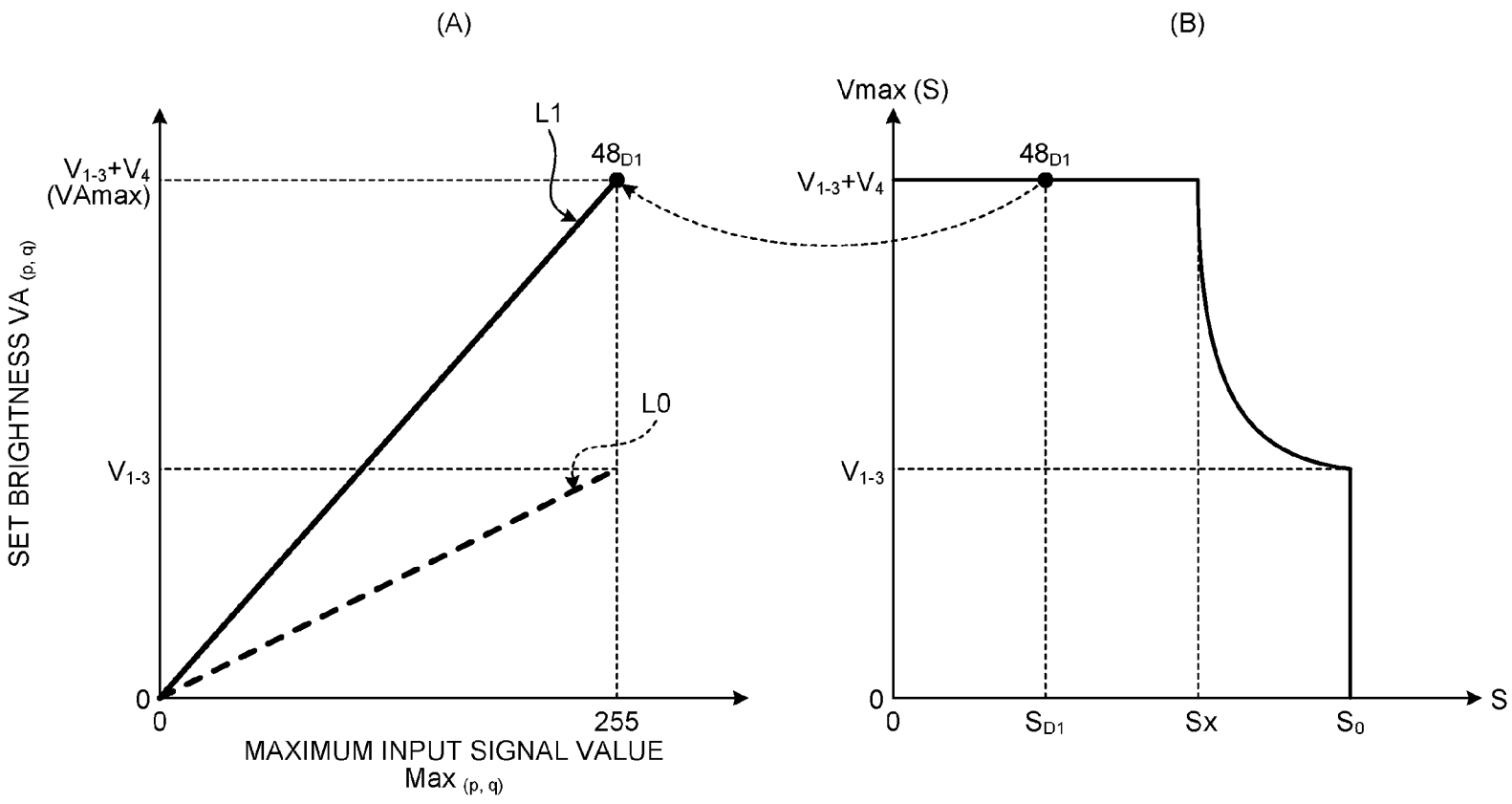
FIG. 11 is a graph illustrating an example of a relation between the saturation and the set brightness.

FIG. 11 is a graph illustrating an example of a relation between the saturation and the set brightness. Similarly to FIG. 10, FIG. 11(A) illustrates a relation between the maximum input signal value $Max_{(p, q)}$ and the set brightness $VA_{(p, q)}$ in a case in which the saturation is 0 to Sx. FIG. 11(B) illustrates a conceptual diagram of the expanded color space corresponding to FIG. 11(A). As illustrated in FIGS. 11(A) and 11(B), in a certain pixel $\mathbf{48}_{D1}$, the maximum input signal value $Max_{(p, q)}$ is 255, the maximum set brightness VAmax is $V_{1\text{-}3}+V_4$, and the saturation $S_{(p, q)}$ is $S_{D1}$ smaller than Sx, so that the set brightness $VA_{(p, q)}$ is the maximum set brightness VAmax (in this case, the maximum brightness $V_{1\text{-}3}+V_4$).

Figure 12:
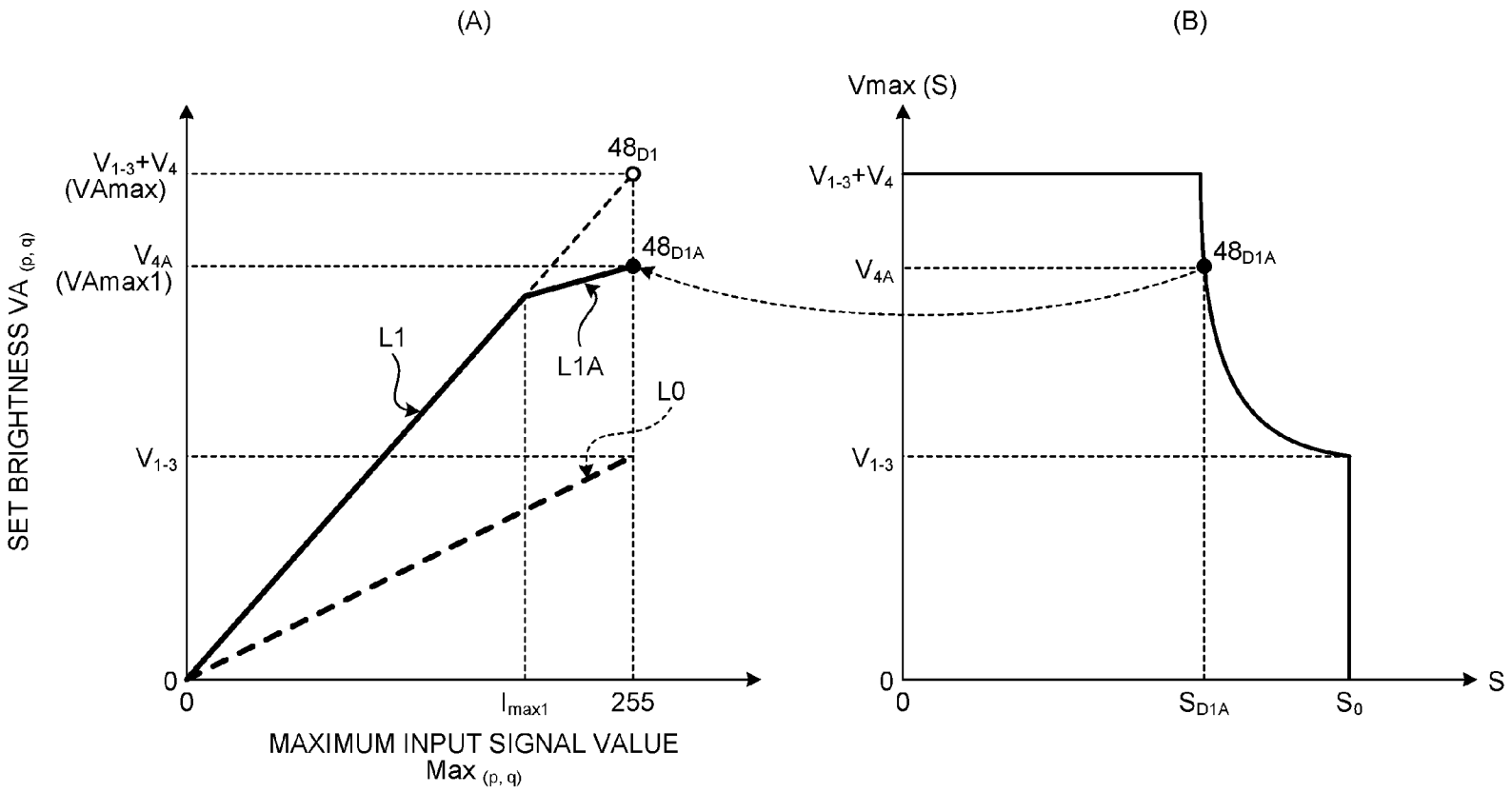
FIG. 12 is a graph illustrating an example of the relation between the saturation and the set brightness.

FIG. 12(A) is a graph illustrating the relation between the maximum input signal value $Max_{(p, q)}$ and the set brightness $VA_{(p, q)}$ when the saturation $S_{(p, q)}$ is equal to or larger than Sx. FIG. 12(B) illustrates a conceptual diagram of the expanded color space corresponding to FIG. 12(A). As illustrated in FIGS. 12(A) and 12(B), in a certain pixel $\mathbf{48}_{D1A}$, the maximum input signal value $Max_{(p, q)}$ is 255 and the maximum set brightness VAmax is $V_{1\text{-}3}+V_4$. However, the pixel $\mathbf{48}_{D1A}$ is different from the pixel $\mathbf{48}_{D1}$ illustrated in FIG. 11 in that the saturation $S_{(p, q)}$ is $S_{D1A}$ larger than Sx, so that the set brightness $VA_{(p, q)}$ is a corrected maximum set brightness $VAmax\mathbf{1}_{(p, q)}$ (in this case, the maximum brightness $V_{4A}$). The maximum brightness $V_{4A}$ is the expanded color space maximum brightness Vmax(S) at the saturation $S_{D1A}$.

More specifically, when the saturation $S_{(p, q)}$ is equal to or larger than Sx, the set brightness calculation unit 76 calculates the corrected maximum set brightness $VAmax\mathbf{1}_{(p, q)}$ by limiting the maximum set brightness VAmax according to the saturation based on the input signal of the pixel 48. The set brightness calculation unit 76 then calculates the set brightness $VA_{(p, q)}$ based on the corrected maximum set brightness $VAmax\mathbf{1}_{(p, q)}$ and the maximum input signal value $Max_{(p, q)}$ in place of the maximum set brightness VAmax. The corrected maximum set brightness $VAmax\mathbf{1}_{(p, q)}$ is determined in accordance with the saturation $S_{(p, q)}$ of the pixel 48, therefore the value thereof is different for each pixel.

When the saturation $S_{(p, q)}$ of the pixel 48 is equal to or larger than Sx, the set brightness calculation unit 76 calculates the corrected maximum set brightness $VAmax\mathbf{1}_{(p, q)}$ according to the following expression (8) using the value of the expanded color space maximum brightness Vmax(S) corresponding to the saturation $S_{(p, q)}$ of the pixel 48.

$$VA\max 1_{(p,q)}=(V\max(S)/(V_{1\text{-}3}+V_4))\cdot VA\max \quad (8)$$

The maximum input signal value of 0 to 255 as a predetermined value of the maximum input signal value $Max_{(p, q)}$ is defined as a maximum input signal value $I_{max1}$. As represented by a line segment L1A in FIG. 12(A), even when the maximum input signal value $Max_{(p, q)}$ is 0 to $I_{max1}$ and the saturation $S_{(p, q)}$ is equal to or larger than Sx, the set brightness calculation unit 76 calculates the set brightness $VA_{(p, q)}$ according to the above expression (6). In other words, even when the saturation $S_{(p, q)}$ is equal to or larger than Sx, the set brightness calculation unit 76 calculates the set brightness $VA_{(p, q)}$ as a value corresponding to the line segment L1 in FIG. 12(A) so long as the maximum input signal value $Max_{(p, q)}$ is 0 to $I_{max1}$.

When the saturation $S_{(p, q)}$ is equal to or larger than Sx and the maximum input signal value $Max_{(p, q)}$ is equal to or larger than $I_{max1}$, the set brightness calculation unit 76 calculates the set brightness $VA_{(p, q)}$ according to the following expression (9).

$$VA_{(p,q)}=k\cdot(VA\max 1_{(p,q)}/V_{1\text{-}3})\cdot Max_{(p,q)}+1 \quad (9)$$

In this case, k and l are coefficients for calculating the set brightness $VA_{(p, q)}$ as a value corresponding to the line segment L1A illustrated in FIG. 12(A). Regarding the line segment L1A, the set brightness $VA_{(p, q)}$ is set to be the corrected maximum set brightness $VAmax\mathbf{1}_{(p, q)}$ when the maximum input signal value $Max_{(p, q)}$ is 255, and the line segment L1A intersects with the line segment L1 when the maximum input signal value $Max_{(p, q)}$ is $I_{max1}$.

In other words, when the saturation $S_{(p, q)}$ of the pixel 48 is equal to or larger than Sx, the set brightness calculation unit 76 increases the set brightness $VA_{(p, q)}$ up to the corrected maximum set brightness $VAmax\mathbf{1}_{(p, q)}$ as the maximum input signal value $Max_{(p, q)}$ increases. The set brightness calculation unit 76 sets an increase rate of the set brightness $VA_{(p, q)}$ in a case in which the maximum input signal value $Max_{(p, q)}$ increases from $I_{max1}$, to be lower than the increase rate of the set brightness $VA_{(p, q)}$ in a case in which the maximum input signal value $Max_{(p, q)}$ increases from 0 to $I_{max1}$. This prevents the brightness of the image from being rapidly changed due to a change in the maximum input signal value $Max_{(p, q)}$.

Figure 13:
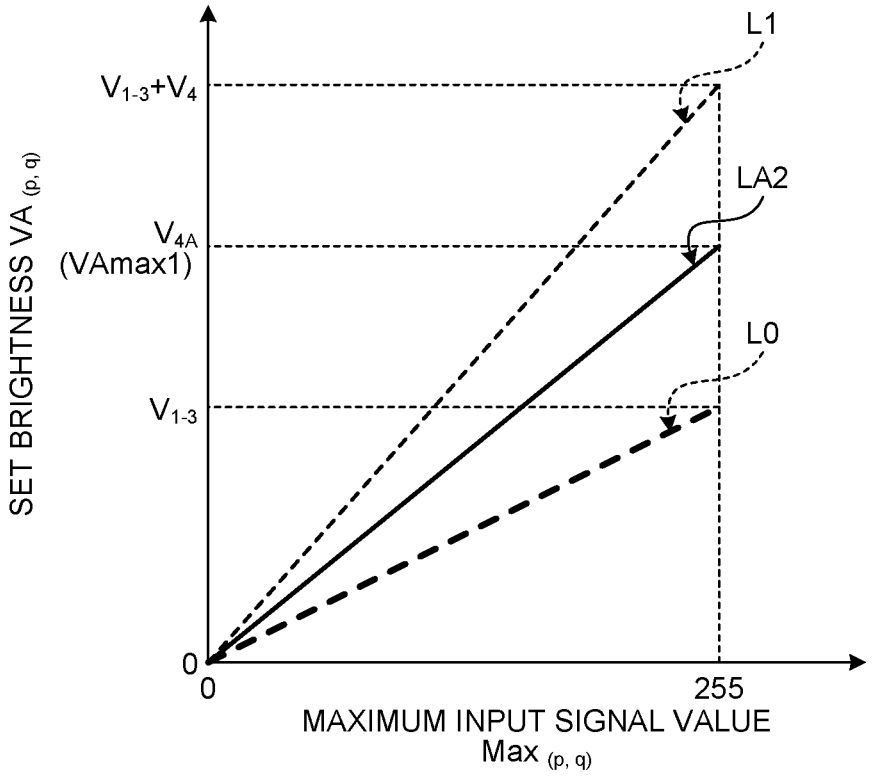
FIG. 13 is a graph illustrating another example of the relation between the saturation and the set brightness.
Figure 14:
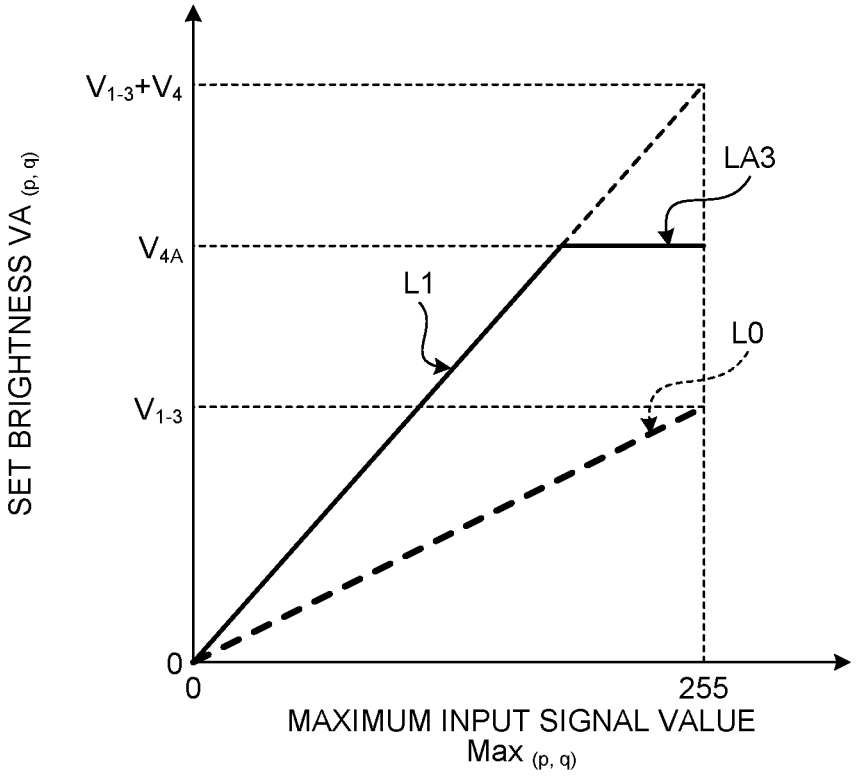
FIG. 14 is a graph illustrating another example of the relation between the saturation and the set brightness.

However, the method of calculating the set brightness $VA_{(p, q)}$ by the set brightness calculation unit 76 in a case in which the saturation $S_{(p, q)}$ is equal to or larger than Sx is not limited to the above expressions (6) and (9) (the line segment L1 and the line segment L1A). It is sufficient that the set brightness calculation unit 76 increases the set brightness $VA_{(p, q)}$ up to the corrected maximum set brightness $VAmax\mathbf{1}_{(p, q)}$ as the maximum input signal value $Max_{(p, q)}$ increases. FIGS. 13 and 14 are graphs illustrating another example of the relation between the saturation and the set brightness. For example, as represented by the line segment LA2 in FIG. 13, when the saturation $S_{(p, q)}$ is equal to or larger than Sx, the set brightness calculation unit 76 may calculate the set brightness $VA_{(p, q)}$ while keeping a rate of increase in the set brightness $VA_{(p, q)}$ constant along with the increase in the maximum input signal value $Max_{(p, q)}$. For example, when the saturation $S_{(p, q)}$ is equal to or larger than Sx, the set brightness calculation unit 76 may calculate the set brightness $VA_{(p, q)}$ according to the expression (6) in the entire range of the maximum input signal value $Max_{(p, q)}$. In this case, as illustrated in FIG. 14, the set brightness $VA_{(p, q)}$ increases up to the maximum brightness $V_{4A}$ according to the expression (6) (line segment L1). However, the set brightness $VA_{(p, q)}$ does not exceed the maximum brightness $V_{4A}$ as the corrected maximum set brightness $VAmax\mathbf{1}_{(p, q)}$. In other words, in this case, the pixel 48 cannot display a brightness larger than the maximum brightness $V_{4A}$. Accordingly, as represented by a line segment LA3 in FIG. 14, after the set brightness $VA_{(p, q)}$ increases to the maximum brightness $V_{4A}$, the set brightness $VA_{(p, q)}$ is the maximum brightness $V_{4A}$ as a constant value even when the maximum input signal value $Max_{(p, q)}$ increases.

As described above, after the set brightness $VA_{(p, q)}$ is calculated, the signal processing unit 20 compares the brightness $V(S)_{(p, q)}$ of the color displayed based on the input signal with the set brightness $VA_{(p, q)}$ to calculate the input expansion coefficient $\alpha_{(p, q)}$ using the α calculation unit 78. The input expansion coefficient $\alpha_{(p, q)}$ is a value determined for each pixel 48. That is, the input expansion coefficient $\alpha_{(p, q)}$ is different for each pixel 48 within one frame depending on the input signal value of the pixel 48. Specifically, the α calculation unit 78 calculates the input expansion coefficient $\alpha_{(p, q)}$ based on the following expression (10).

$$\alpha_{(p,q)}=VA_{(p,q)}/V(S)_{(p,q)} \tag{10}$$

The value of the brightness $V(S)_{(p, q)}$ is the same as the maximum input signal value $Max_{(p, q)}$, so that the α calculation unit 78 calculates the input expansion coefficient $\alpha_{(p, q)}$ based on the maximum input signal value $Max_{(p, q)}$. The α calculation unit 78 may calculate the input expansion coefficient $\alpha_{(p, q)}$ using the luminance $L_{(p, q)}$ represented by the above expression (4) in place of the brightness $V(S)_{(p, q)}$ or the maximum input signal value $Max_{(p, q)}$. In this case, the α calculation unit 78 calculates the input expansion coefficient $\alpha_{(p, q)}$ using the luminance $L_{(p, q)}$ in place of the brightness $V(S)_{(p, q)}$ according to the expression (10).

Next, the signal processing unit 20 causes the input expansion signal generation unit 79 to expand the signal value of the input signal with the input expansion coefficient $\alpha_{(p, q)}$ to generate the input expansion signal for each pixel 48. Specifically, the input expansion signal generation unit 79 generates the input expansion signal of the first sub-pixel 49R (signal value $xA_{1-(p, q)}$, the input expansion signal of the second sub-pixel 49G (signal value $xA_{2-(p, q)}$, and the input expansion signal of the third sub-pixel 49B (signal value $xA_{3-(p, q)}$) according to the following expressions (11), (12), and (13).

$$xA_{1-(p,q)}=\alpha_{(p,q)}\cdot x_{1-(p,q)} \tag{11}$$

$$xA_{2-(p,q)}=\alpha_{(p,q)}\cdot x_{2-(p,q)} \tag{12}$$

$$xA_{3-(p,q)}=\alpha_{(p,q)}\cdot x_{3-(p,q)} \tag{13}$$

Figure 15:
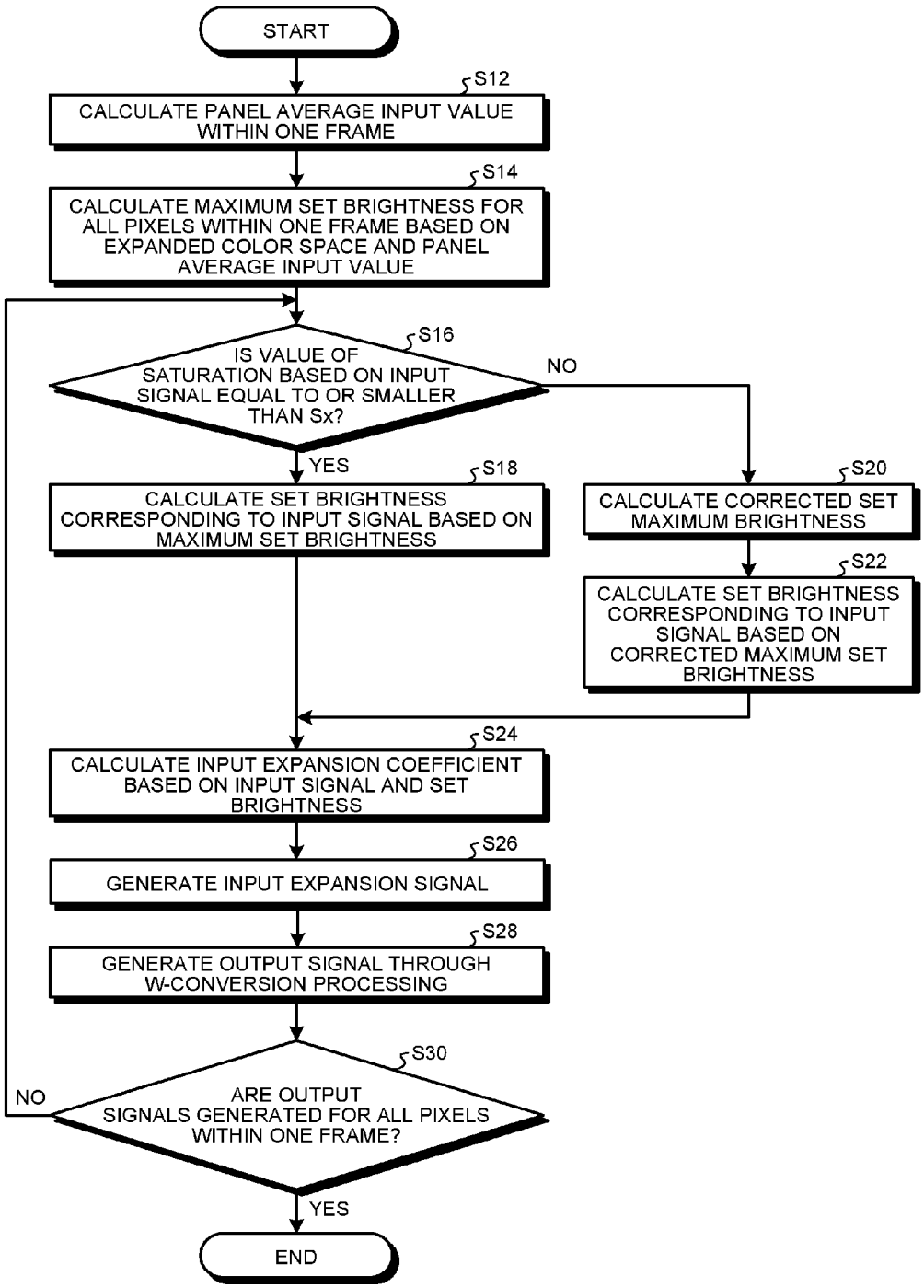
FIG. 15 is a flowchart of processing of generating an output signal performed by the signal processing unit.

The processing of generating the input expansion signal performed by the signal processing unit 20 has been described above. The following describes a procedure of generating the output signal including a procedure of the processing based on a flowchart. FIG. 15 is a flowchart of the processing of generating the output signal performed by the signal processing unit.

As illustrated in FIG. 15, in generating the input expansion signal, the signal processing unit 20 first calculates the panel average input value $I_{AV}$ based on the input signals of all of the pixels 48 within one frame (Step S12). Specifically, the signal processing unit 20 causes the panel average input value calculation unit 72 to calculate the panel average input value $I_{AV}$ as an average input gradation value of all of the pixels 48 within one frame based on the above expressions (1) and (2).

After the panel average input value $I_{AV}$ is calculated, the signal processing unit 20 causes the maximum set brightness calculation unit 74 to calculate the maximum set brightness VAmax of all of the pixels 48 within one frame based on the panel average input value $I_{AV}$ and the data of the expanded color space (Step S14). Specifically, the maximum set brightness calculation unit 74 reads out the value of the expanded color space maximum brightness Vmax(S) (in this case, the maximum brightness $V_{1-3}$, $V_4$) in the expanded color space 110, and calculates the maximum set brightness VAmax based on the above expression (3). The maximum set brightness VAmax is calculated as a value common to all of the pixels 48 within one frame.

After the maximum set brightness VAmax is calculated, the signal processing unit 20 causes the set brightness calculation unit 76 to determine whether the saturation $S_{(p, q)}$ based on the input signal of the pixel 48 is equal to or smaller than the saturation Sx (Step S16).

When the saturation $S_{(p, q)}$ is equal to or smaller than Sx (Yes at Step S16), the signal processing unit 20 causes the set brightness calculation unit 76 to calculate the set brightness $VA_{(p, q)}$ of the pixel 48 based on the input signal and the value of the maximum set brightness VAmax (Step S18). Specifically, the set brightness calculation unit 76 calculates the set brightness $VA_{(p, q)}$ based on the above expression (6).

When the saturation $S_{(p, q)}$ is not equal to or smaller than Sx (No at Step S16), the signal processing unit 20 causes the set brightness calculation unit 76 to calculate the corrected maximum set brightness $VAmax\mathbf{1}_{(p, q)}$ based on the maximum set brightness VAmax and the maximum brightness $V_{4A}$ in the expanded color space 110 at the saturation $S_{(p, q)}$ (Step S20). Specifically, the set brightness calculation unit 76 calculates the corrected maximum set brightness $VAmax\mathbf{1}_{(p, q)}$ based on the above expression (8).

After the corrected maximum set brightness $VAmax\mathbf{1}_{(p, q)}$ is calculated, the signal processing unit 20 causes the set brightness calculation unit 76 to calculate the set brightness $VA_{(p, q)}$ of the pixel 48 based on the input signal and the value of the corrected maximum set brightness $VAmax1_{(p, q)}$ (Step S22). Specifically, when the maximum input signal value $Max_{(p, q)}$ is 0 to $I_{max1}$, the set brightness calculation unit 76 calculates the set brightness $VA_{(p, q)}$ according to the above expression (6). When the maximum input signal value $Max_{(p, q)}$ is equal to or larger than $I_{max1}$, the set brightness calculation unit 76 calculates the set brightness $VA_{(p, q)}$ according to the above expression (9).

After the set brightness $VA_{(p, q)}$ is calculated at Step S18 or Step S22, the signal processing unit 20 causes the α calculation unit 78 to compare the set brightness $VA_{(p, q)}$ with the brightness $V(S)_{(p, q)}$ of the color displayed based on the input signal to calculate the input expansion coefficient $\alpha_{(p, q)}$ (Step S24). Specifically, the α calculation unit 78 calculates the input expansion coefficient $\alpha_{(p, q)}$ based on the above expression (10).

After the input expansion coefficient $\alpha_{(p, q)}$ is calculated, the signal processing unit 20 causes the input expansion signal generation unit 79 to expand the signal value of the input signal with the input expansion coefficient $\alpha_{(p, q)}$ to generate the input expansion signal for each pixel 48 (Step S26). Specifically, the input expansion signal generation unit 79 generates the input expansion signal of the first sub-pixel 49R (signal value $xA_{1-(p, q)}$), the input expansion signal of the second sub-pixel 49G (signal value $xA_{2-(p, q)}$), and the input expansion signal of the third sub-pixel 49B (signal value $xA_{3-(p, q)}$ according to the above expressions (11), (12), and (13).

After the input expansion signal of the pixel 48 is generated, the signal processing unit 20 causes the W-conversion processing unit 80 to perform W-conversion processing to generate the output signal based on the input expansion signal (Step S28). The signal processing unit 20 causes the gamma conversion unit 82 to generate the image output signal from the output signal and output the image output signal to the image display panel driving unit 30. The processing of generating the output signal will be described later.

After the output signal is generated, the signal processing unit 20 causes the W-conversion processing unit 80 to determine whether the output signal is generated for all of the pixels 48 within one frame (Step S30).

When the output signal is not yet generated for all of the pixels 48 within one frame (No at Step S30), the process returns to Step S16, and the signal processing unit 20 performs processing of generating the output signal for the pixel 48 that has not generated the output signal within one frame.

When the output signal is generated for all of the pixels 48 within one frame (Yes at Step S30), the signal processing unit 20 ends the processing of generating the output signal, and the process proceeds to similar processing for the next frame. The signal processing unit 20 generates the output signal through such a procedure.

Processing of Generating Output Signal

The following describes the processing of generating the output signal based on the input expansion signal. The signal processing unit 20 causes the input expansion signal generation unit 79 to generate the input expansion signal of the first sub-pixel 49R (signal value $xA_{1-(p, q)}$), the input expansion signal of the second sub-pixel 49G (signal value $xA_{2-(p, q)}$, and the input expansion signal of the third sub-pixel 49B (signal value $xA_{3-(p, q)}$). The signal processing unit 20 causes the W-conversion processing unit 80 to generate the output signal of the first sub-pixel (signal value $X_{1-(p, q)}$) for determining the display gradation of the first sub-pixel 49R, the output signal of the second sub-pixel (signal value $X_{2-(p, q)}$) for determining the display gradation of the second sub-pixel 49G, the output signal of the third sub-pixel (signal value $X_{3-(p, q)}$) for determining the display gradation of the third sub-pixel 49B, and the output signal of the fourth sub-pixel (signal value $X_{4-(p, q)}$) for determining the display gradation of the fourth sub-pixel 49W based on the input expansion signals.

The signal processing unit 20 causes the W-conversion processing unit 80 to calculate the output signal value $X_{4-(p, q)}$ of the fourth sub-pixel based on at least the input expansion signal of the first sub-pixel (signal value $xA_{1-(p, q)}$), the input expansion signal of the second sub-pixel (signal value $xA_{2-(p, q)}$), and the input expansion signal of the third sub-pixel (signal value $xA_{3-(p, q)}$). More specifically, the signal processing unit 20 obtains the output signal value $X_{4-(p, q)}$ of the fourth sub-pixel based on $MinA_{(p, q)}$ as the minimum value of the input expansion signal in one pixel. Specifically, the signal processing unit 20 obtains the signal value $X_{4-(p, q)}$ based on the following expression (14). $MinA_{(p, q)}$ is the minimum value among the input expansion signal values of three sub-pixels 49, that is, ($xA_{1-(p, q)}$, $xA_{2-(p, q)}$, $xA_{3-(p, q)}$). Description of χ will be provided later.

$$X_{4-(p,q)}=\mathrm{Min}A_{(p,q)}/\chi \tag{14}$$

In this expression, χ is a constant depending on the display device 10. No color filter is provided to the fourth sub-pixel 49W that displays white. The fourth sub-pixel 49W that displays the fourth color is brighter than the first sub-pixel 49R that displays the first color, the second sub-pixel 49G that displays the second color, and the third sub-pixel 49B that displays the third color when they are illuminated with the same lighting quantity of a light source. When a signal having a value corresponding to a maximum signal value of the output signal of the first sub-pixel 49R is input to the first sub-pixel 49R, a signal having a value corresponding to the maximum signal value of the output signal of the second sub-pixel 49G is input to the second sub-pixel 49G, and a signal having a value corresponding to the maximum signal value of the output signal of the third sub-pixel 49B is input to the third sub-pixel 49B, the luminance of an aggregate of the first sub-pixel 49R, the second sub-pixel 49G, and the third sub-pixel 49B included in the pixel 48 or a group of the pixels 48 is represented by $BN_{1-3}$. The luminance of the fourth sub-pixel 49W is represented by $BN_4$ in a case in which a signal having a value corresponding to the maximum signal value of the output signal of the fourth sub-pixel 49W is input to the fourth sub-pixel 49W included in the pixel 48 or a group of the pixels 48. That is, white with the maximum luminance is displayed by the aggregate of the first sub-pixel 49R, the second sub-pixel 49G, and the third sub-pixel 49B, and the luminance of white is represented by $BN_{1-3}$. When χ is a constant depending on the display device 10, the constant χ is given by $\chi=BN_4/BN_{1-3}$.

Specifically, the luminance $BN_4$ in a case in which the input signal having a display gradation value of 255 is assumed to be input to the fourth sub-pixel 49W is 1.5 times the luminance $BN_{1-3}$ of white in a case in which the signal value $x_{1-(p, q)}=255$, the signal value $x_{2-(p, q)}=255$, and the signal value $x_{3-(p, q)}=255$ are input to the aggregate of the first sub-pixel 49R, the second sub-pixel 49G, and the third sub-pixel 49B as input signals having the above display gradation value. That is, $\chi=1.5$ in the first embodiment.

The expanded color space maximum brightness Vmax(S) can be represented by the following expressions (15) and (16) using the constant $\chi$.

When $S \leq Sx$:

$$V\max(S)=(\chi+1)\cdot(2^n-1) \quad (15)$$

When $Sx<S\leq 1$:

$$V\max(S)=(2^n-1)\cdot(1/S) \quad (16)$$

In these expressions, $Sx=1/(\chi+1)$.

Next, the signal processing unit 20 causes the W-conversion processing unit 80 to calculate the output signal of the first sub-pixel (signal value $X_{1-(p,\ q)}$) based on at least the input expansion signal of the first sub-pixel (signal value $xA_{1-(p,\ q)}$), calculate the output signal of the second sub-pixel (signal value $X_{2-(p,\ q)}$) based on at least the input expansion signal of the second sub-pixel (signal value $xA_{2-(p,\ q)}$), and calculate the output signal of the third sub-pixel (signal value $X_{3-(p,\ q)}$) based on at least the input expansion signal of the third sub-pixel (signal value $xA_{3-(p,\ q)}$).

Specifically, the signal processing unit 20 calculates the output signal of the first sub-pixel based on the input expansion signal of the first sub-pixel and the output signal of the fourth sub-pixel, calculates the output signal of the second sub-pixel based on the input expansion signal of the second sub-pixel and the output signal of the fourth sub-pixel, and calculates the output signal of the third sub-pixel based on the input expansion signal of the third sub-pixel and the output signal of the fourth sub-pixel.

That is, assuming that $\chi$ is a constant depending on the display device, the signal processing unit 20 obtains the output signal value $X_{1-(p,\ q)}$) of the first sub-pixel, the output signal value $X_{2-(p,\ q)}$ of the second sub-pixel, and the output signal value $X_{3-(p,\ q)}$ of the third sub-pixel for the (p, q)-th pixel (or a group of the first sub-pixel 49R, the second sub-pixel 49G, and the third sub-pixel 49B) using the following expressions (17), (18), and (19).

$$X_{1-(p,q)}=xA_{1-(p,q)}-\chi\cdot X_{4-(p,q)} \quad (17)$$

$$X_{2-(p,q)}=xA_{2-(p,q)}-\chi\cdot X_{4-(p,q)} \quad (18)$$

$$X_{3-(p,q)}=xA_{3-(p,q)}-\chi\cdot X_{4-(p,q)} \quad (19)$$

As described above, the signal processing unit 20 according to the first embodiment determines the maximum set brightness VAmax within a range of the brightness that can be displayed in the expanded color space 110, and so that the maximum set brightness VAmax increases as the panel average input value $I_{AV}$ decreases. The signal processing unit 20 determines the input expansion coefficient for expanding the color to be displayed by the image display panel 40 to the color corresponding to the maximum set brightness VAmax. The signal processing unit 20 then obtains the input expansion signal of each pixel based on the input expansion coefficient, and generates the output signal based on the input expansion signal. Thus, the display device 10 can expand the brightness of the color to be displayed by the image display panel 40 to the maximum set brightness VAmax, that is, the brightness in the expanded color space. Accordingly, the display device 10 can increase a brightness difference among the pixels within one frame, widen a dynamic range, and appropriately improve contrast of the image.

The display device 10 increases the maximum set brightness VAmax as the panel average input value $I_{AV}$ decreases. That is, the display device 10 increases the maximum set brightness VAmax as the image is darker as a whole. Accordingly, when the image is dark as a whole, the display device 10 can further increase the brightness difference among the pixels, and widen the dynamic range to clearly display the image.

When the panel average input value $I_{AV}$ is equal to or larger than $I_{AV}2$, the signal processing unit 20 sets the value of the maximum set brightness VAmax to be the maximum brightness $V_{1-3}$ in the standard color space. When the panel average input value $I_{AV}$ is equal to or smaller than $I_{AV}1$, the signal processing unit 20 sets the value of the maximum set brightness VAmax to be the maximum brightness $V_{1-3}+V_4$ in the expanded color space. As the panel average input value $I_{AV}$ decreases from $I_{AV}2$ toward $I_{AV}1$, the signal processing unit 20 increases the value of the maximum set brightness VAmax from the maximum brightness $V_{1-3}$ toward the maximum brightness $V_{1-3}+V_4$. That is, when the image is bright as a whole, the display device 10 prevents the brightness difference among the pixels from increasing, and when the image is dark as a whole, the display device 10 increases the brightness difference among the pixels. Thus, when the image that is bright as a whole is switched to the image that is dark as a whole, for example, the display device 10 can display the image more clearly.

The signal processing unit 20 also determines the input expansion coefficient $\alpha_{(p,\ q)}$ for each pixel 48 so that the set brightness $VA_{(p,\ q)}$ increases up to the maximum set brightness VAmax as the input signal value increases. The display device 10 changes the brightness of the color to be displayed to increase up to the set brightness VAmax according to the input signal, thereby appropriately widening the dynamic range to improve the contrast of the image.

The maximum set brightness VAmax is the brightness that can be expressed in the expanded color space, and calculated according to the expression (3). The set brightness $VA_{(p,\ q)}$ is calculated as in the expression (6), for example. Thus, the maximum set brightness VAmax can also be called the upper limit value of the input expansion signal value that can be extended in the expanded color space. The set brightness $VA_{(p,\ q)}$ can also be called the input expansion signal value of the pixel 48.

Second Embodiment

The following describes a second embodiment of the present invention. A display device 10*a* according to the second embodiment stores an expanded color space different from that of the display device 10 according to the first embodiment. The configuration of the display device 10*a* according to the second embodiment is the same as that of the display device 10 according to the first embodiment except the expanded color space, so that redundant description will not be repeated.

Figure 16:
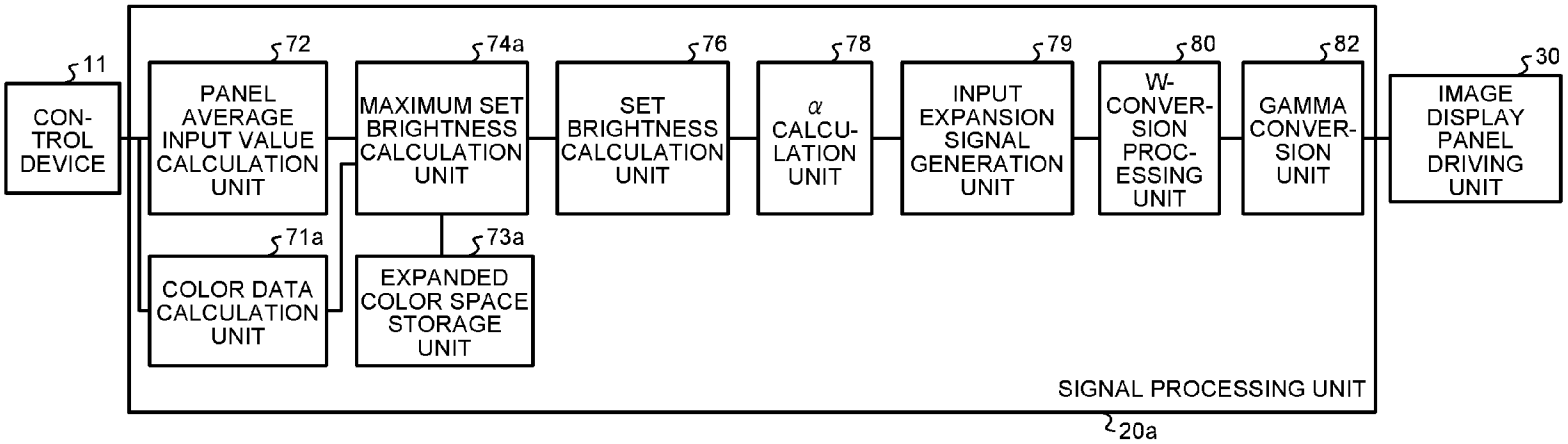
FIG. 16 is a block diagram illustrating the configuration of a signal processing unit according to a second embodiment.

FIG. 16 is a block diagram illustrating the configuration of a signal processing unit according to the second embodiment. As illustrated in FIG. 16, a signal processing unit 20*a* according to the second embodiment includes a color data calculation unit 71*a*, an expanded color space storage unit 73*a*, and a maximum set brightness calculation unit 74*a*. The color data calculation unit 71*a* receives an input signal input from the control device 11. The color data calculation unit 71*a* calculates, from the input value of the input signal, the hue H of a color to be displayed by the pixel 48 due to the input signal. The color data calculation unit 71*a* outputs the calculated value of the hue to the maximum set brightness calculation unit 74*a*. The hue H is calculated according to the following expression (20).

$$H = \begin{cases} \text{undefinded}, & \text{if } \mathrm{Min}_{(p,q)} = \mathrm{Max}_{(p,q)} \\ 60 \times \dfrac{X_{2-(p,q)} - X_{1-(p,q)}}{\mathrm{Max}_{(p,q)} - \mathrm{Min}_{(p,q)}} + 60, & \text{if } \mathrm{Min}_{(p,q)} = X_{3-(p,q)} \\ 60 \times \dfrac{X_{3-(p,q)} - X_{2-(p,q)}}{\mathrm{Max}_{(p,q)} - \mathrm{Min}_{(p,q)}} + 180, & \text{if } \mathrm{Min}_{(p,q)} = X_{1-(p,q)} \\ 60 \times \dfrac{X_{1-(p,q)} - X_{3-(p,q)}}{\mathrm{Max}_{(p,q)} - \mathrm{Min}_{(p,q)}} + 300, & \text{if } \mathrm{Min}_{(p,q)} = X_{2-(p,q)} \end{cases} \quad (20)$$

The expanded color space storage unit 73*a* stores an expanded color space 110*a*. For example, the expanded color space storage unit 73*a* stores the upper limit value of the brightness that can be extended in the expanded color space 110*a* for each combination of the saturation and the hue. Although details will be described later, the expanded color space 110*a* is a color space that represents a range of the color that can be displayed by the image display panel 40, and determined based on the element characteristic of each sub-pixel 49. For example, to the expanded color space storage unit 73*a*, written is data of the expanded color space 110*a* calculated as experiment data, or the data of the expanded color space 110*a* determined based on the element characteristic of each sub-pixel 49 inspected when a product is shipped and the like.

The maximum set brightness calculation unit 74*a* reads out the data of the expanded color space 110*a* corresponding to the value of the hue H from the expanded color space storage unit 73*a*. The maximum set brightness calculation unit 74*a* calculates the maximum set brightness VAmax for all of the pixels 48 within one frame, from the data of the expanded color space 110*a* corresponding to the value of the hue H and the panel average input value $I_{AV}$.

The following describes the expanded color space 110*a* according to the second embodiment. First, the following describes a brightness difference among the sub-pixels 49.

The element characteristics such as the color to be displayed and individual variation of the lighting drive circuit are different among the first sub-pixel 49R, the second sub-pixel 49G, and the third sub-pixel 49B, so that a displayable upper limit value of the brightness of the color displayed is different thereamong. The displayable upper limit value of the brightness of red (the first color) of the first sub-pixel 49R is referred to as a first sub-pixel maximum brightness, the displayable upper limit value of the brightness of green (the second color) of the second sub-pixel 49G is referred to as a second sub-pixel maximum brightness, and the displayable upper limit value of the brightness of blue (the third color) of the third sub-pixel 49B is referred to as a third sub-pixel maximum brightness. That is, the first sub-pixel maximum brightness, the second sub-pixel maximum brightness, and the third sub-pixel maximum brightness are brightnesses of colors displayed by the first sub-pixel 49R, the second sub-pixel 49G, and the third sub-pixel 49B when an output signal having a maximum gradation value is output to each sub-pixel 49.

In the first embodiment, descending order of the values of the brightness is as follows: the second sub-pixel maximum brightness, the first sub-pixel maximum brightness, and the third sub-pixel maximum brightness. That is, the brightness of the color that can be displayed by the second sub-pixel 49G is the largest, the brightness of the color that can be displayed by the first sub-pixel 49R is the next largest, and the brightness of the color that can be displayed by the third sub-pixel 49B is the smallest. However, the first color, the second color, and the third color can be arbitrarily set, so that a magnitude relation among the first sub-pixel maximum brightness, the second sub-pixel maximum brightness, and the third sub-pixel maximum brightness is not limited thereto. When the third sub-pixel maximum brightness is smaller than one of the first sub-pixel maximum brightness and the second sub-pixel maximum brightness, and equal to or smaller than the other one thereof, the sub-pixel 49 can optionally set a color to be displayed, a configuration, and the like for each sub-pixel.

The following describes a difference between the expanded color space 110 according to the first embodiment and the expanded color space 110*a* according to the second embodiment. As described above, the element characteristics are different among the first sub-pixel 49R, the second sub-pixel 49G, and the third sub-pixel 49B, so that the first sub-pixel maximum brightness, the second sub-pixel maximum brightness, and the third sub-pixel maximum brightness are different from each other. The third sub-pixel maximum brightness is smaller than the first sub-pixel maximum brightness and the second sub-pixel maximum brightness. That is, even when the input signal value having the same maximum gradation is input, the brightness of blue displayed by the third sub-pixel 49B is smaller than the brightness of red and green displayed by the first sub-pixel 49R and the second sub-pixel 49G, respectively. Accordingly, for example, when the input signal values having the same maximum gradation are input to the respective first sub-pixel 49R, the second sub-pixel 49G, and the third sub-pixel 49B to display white, the brightness is different among the respective colors, so that a color shifted from white may be displayed in some cases. For this, similarly to the display device 10 according to the first embodiment, to keep color balance, the display device typically limits the maximum brightness (the upper limit value of displayable brightness) of the first sub-pixel 49R and the second sub-pixel 49G in accordance with the maximum brightness of the third sub-pixel 49B. In this case, the maximum brightnesses of the first sub-pixel 49R and the second sub-pixel 49G are limited in accordance with the third sub-pixel maximum brightness of the third sub-pixel 49B, so that the displayable maximum brightness of the color displayed by combining the colors of the first sub-pixel 49R, the second sub-pixel 49G, and the third sub-pixel 49B is the third sub-pixel maximum brightness irrespective of the hue.

The fourth sub-pixel 49W can widen the dynamic range of the brightness by adding a white component as compared with a case of displaying the color only with the first sub-pixel 49R, the second sub-pixel 49G, and the third sub-pixel 49B. In this way, a color space expanded by adding the fourth sub-pixel 49W in which the displayable maximum brightnesses of the first sub-pixel 49R and the second sub-pixel 49G are limited in accordance with the third sub-pixel maximum brightness is the expanded color space 110 according to the first embodiment as the standard color space. In other words, the expanded color space 110 according to the first embodiment is a color space that can be extended with the first color (red), the second color (green), the third color (blue), and the fourth color (white) in a case in which the output signal for displaying the color the maximum brightness of which is limited up to the third sub-pixel maximum brightness is output to the first sub-pixel 49R and the second sub-pixel 49G, the output signal for displaying the color of the third sub-pixel maximum brightness is output to the third sub-pixel 49B, and the output signal for displaying the color of the fourth sub-pixel maximum brightness is output to the fourth sub-pixel 49W. The display device 10 according to the first embodiment generates the input expansion signal to display the color in a range of the expanded color space 110. The relation between the saturation and the brightness in the expanded color space 110 according to the first embodiment is the same irrespective of the hue.

Figure 17:
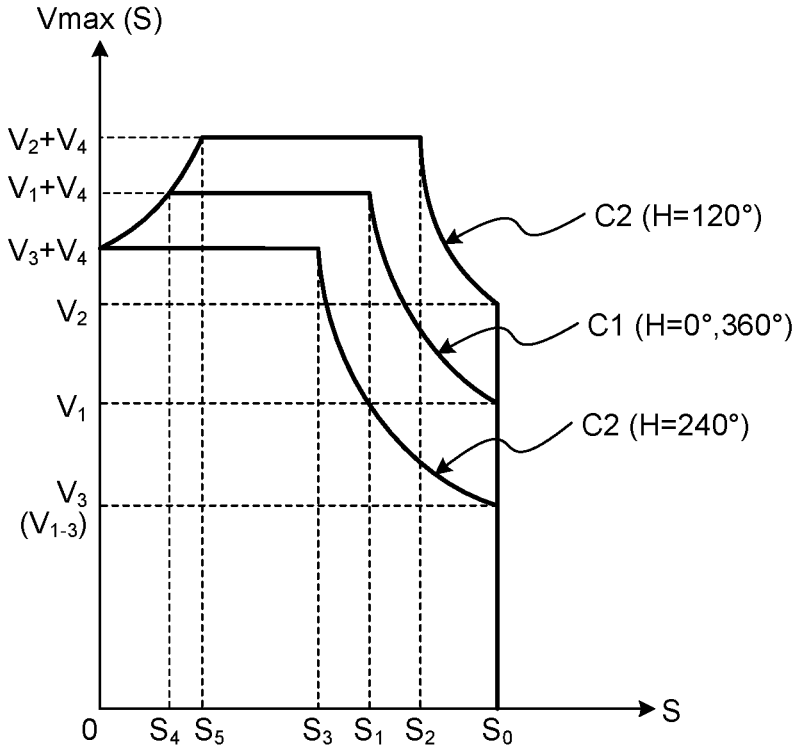
FIG. 17 is a conceptual diagram illustrating the relation between the saturation and the brightness in the expanded color space with hues of a first color, a second color, and a third color.
Figure 18:
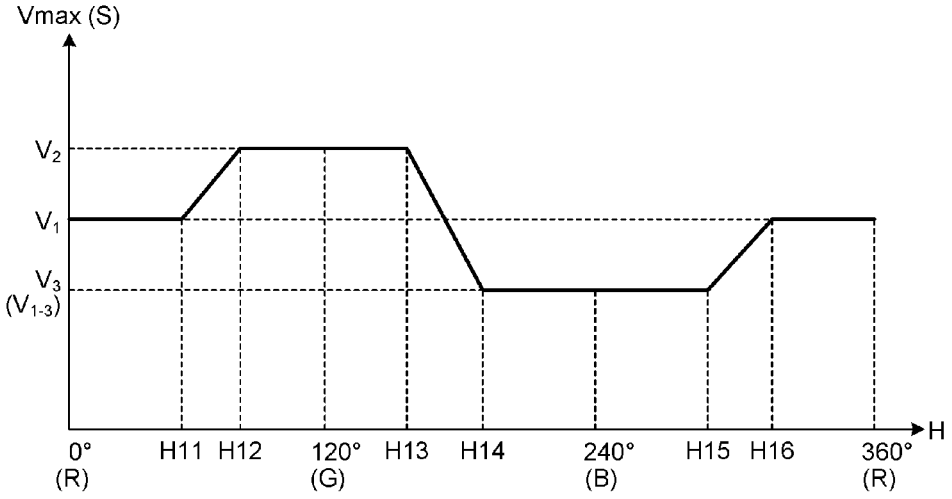
FIG. 18 is a conceptual diagram illustrating a relation between the hue and the brightness in the expanded color space at a maximum saturation.

On the other hand, the expanded color space 110*a* according to the second embodiment is a color space that does not limit the maximum brightness of the first sub-pixel 49R and the second sub-pixel 49G. FIG. 17 is a conceptual diagram illustrating the relation between the saturation and the brightness in the expanded color space with hues of the first color, the second color, and the third color. FIG. 18 is a conceptual diagram illustrating a relation between the hue and the brightness in the expanded color space at a maximum saturation. As illustrated in FIG. 18, the hue H is represented in a range from 0° to 360°. From 0° toward 360°, the hue changes from red to yellow, green, cyan, blue, magenta, and back to red. In the second embodiment, the region including angles 0° and 360° is red, the region including the angle 120° is green, and the region including the angle 240° is blue.

A line segment C1 in FIG. 17 indicates the maximum brightness corresponding to the saturation in a case of displaying the color of the hue of the first color (red) without limiting the maximum brightness with the first sub-pixel 49R and the fourth sub-pixel 49W. That is, the line segment C1 indicates the upper limit value of the color space extended with the hue of the first color (red) in a case in which the output signal for displaying the color of the first sub-pixel maximum brightness is output to the first sub-pixel 49R, and the output signal for displaying the color of the fourth sub-pixel maximum brightness is output to the fourth sub-pixel 49W by expanding the input signal. The hue represented by the line segment C1 is red, so that the hue H is 0° and 360°.

A line segment C2 in FIG. 17 indicates the maximum brightness corresponding to the saturation in a case of displaying the color of the hue of the second color (green) without limiting the maximum brightness with the second sub-pixel 49G and the fourth sub-pixel 49W. That is, the line segment C2 indicates the upper limit value of the color space extended with the hue of the second color (green) in a case in which the output signal for displaying the color of the second sub-pixel maximum brightness is output to the second sub-pixel 49G, and the output signal for displaying the color of the fourth sub-pixel maximum brightness is output to the fourth sub-pixel 49W by expanding the input signal. The hue represented by the line segment C2 is green, so that the hue H is 120°.

A line segment C3 in FIG. 17 indicates the maximum brightness corresponding to the saturation in a case of displaying the color of the hue of the third color (blue) without limiting the maximum brightness with the third sub-pixel 49B and the fourth sub-pixel 49W. That is, the line segment C3 indicates the upper limit value of the color space extended with the hue of the third color (blue) in a case in which the output signal for displaying the color of the third sub-pixel maximum brightness is output to the third sub-pixel 49B, and the output signal for displaying the color of the fourth sub-pixel maximum brightness is output to the fourth sub-pixel 49W by expanding the input signal. The hue represented by the line segment C3 is blue, so that the hue H is 240°. The line segment C3 corresponds to the third sub-pixel maximum brightness, so that the line segment C3 is the same as a line segment indicating the maximum brightness of the expanded color space 110 according to the first embodiment.

The first sub-pixel maximum brightness is represented by $V_1$, the second sub-pixel maximum brightness is represented by $V_2$, and the third sub-pixel maximum brightness is represented by $V_3$. As described above, the fourth sub-pixel maximum brightness is represented by $V_4$. In this case, as indicated by the line segment C1, in a case in which the brightness is not limited, the maximum brightness with the hue of the first color (for example, red) is a brightness $V_3+V_4$ obtained by adding the fourth sub-pixel maximum brightness $V_4$ to the third sub-pixel maximum brightness $V_3$ at the saturation 0. The maximum brightness increases when the saturation is in a range from 0 to $S_4$, becomes a brightness $V_1+V_4$ obtained by adding the fourth sub-pixel maximum brightness $V_4$ to the first sub-pixel maximum brightness $V_1$ at the saturation $S_4$, and becomes the brightness $V_1+V_4$ when the saturation is in a range from $S_4$ to $S_1$. The maximum brightness then decreases when the saturation is in a range from $S_1$ toward $S_0$ as the maximum value of the saturation. The maximum brightness is the first sub-pixel maximum brightness $V_1$ at the saturation $S_0$. The saturation $S_1$ is larger than the saturation $S_3$.

As indicated by the line segment C2, in a case in which the brightness is not limited, the maximum brightness with the hue of the second color (for example, green) is the brightness $V_3+V_4$ at the saturation 0. The maximum brightness increases when the saturation is in a range from 0 to $S_5$, becomes brightness $V_2+V_4$ obtained by adding the fourth sub-pixel maximum brightness $V_4$ to the second sub-pixel maximum brightness $V_2$ at the saturation $S_5$, and becomes the brightness $V_2+V_4$ when the saturation is in a range from $S_5$ to $S_2$. The maximum brightness then decreases when the saturation is in a range from $S_2$ toward $S_0$ as the maximum value of the saturation. The maximum brightness is the second sub-pixel maximum brightness $V_2$ at the saturation $S_0$. The saturation $S_2$ is larger than the saturation $S_1$. The saturation $S_5$ is larger than the saturation $S_4$.

As indicated by the line segment C3, in a case in which the brightness is not limited, the expanded color space maximum brightness Vmax(S) with the hue of the third color (for example, blue) is the brightness $V_3+V_4$ when the saturation is in a range from 0 to $S_3$. The expanded color space maximum brightness Vmax(S) then decreases when the saturation is in a range from $S_3$ toward $S_0$ as the maximum value of the saturation. The expanded color space maximum brightness Vmax(S) is the third sub-pixel maximum brightness $V_3$ at the saturation $S_0$. As described above, the line segment C3 is the same as the line segment indicating the maximum brightness of the expanded color space 110 according to the first embodiment. Accordingly, in a case in which the brightness is not limited, the expanded color space maximum brightness Vmax(S) with the hue of the third color (blue) is the same as the expanded color space maximum brightness Vmax(S) in the expanded color space 110. That is, the saturation $S_3$ is the saturation Sx in the expanded color space 110, and the third sub-pixel maximum brightness $V_3$ is the maximum brightness $V_{1\text{-}3}$ in the expanded color space 110. The line segments C1, C2, and C3 are merely examples, and differ depending on the color and the like displayed by each sub-pixel.

The expanded color space storage unit 73*a* stores the value of the expanded color space maximum brightness Vmax(S) corresponding to the saturation in a case in which the color of the hue of the first color (for example, red) is displayed without limiting the maximum brightness as indicated by the line segment C1. The expanded color space storage unit 73*a* stores the value of the expanded color space maximum brightness Vmax(S) corresponding to the saturation in a case in which the color of the hue of the second color (for example, green) is displayed without limiting the maximum brightness as indicated by the line segment C2. The expanded color space storage unit 73*a* stores the value of the expanded color space maximum brightness Vmax(S) corresponding to the saturation in a case in which the color of the hue of the third color (for example, blue) is displayed without limiting the maximum brightness as indicated by the line segment C3. By being written with these pieces of data calculated as experiment data or these pieces of data calculated through inspection when a product is shipped and the like, the expanded color space storage unit 73*a* stores the value of the expanded color space maximum brightness Vmax(S) corresponding to the saturation with the hues of the first color, the second color, and the third color. The expanded color space storage unit 73*a* calculates the value of the maximum brightness corresponding to the saturation with each hue by combining the values of the maximum brightness corresponding to the saturation with the hues of the first color, the second color, and the third color, and stores the color space not exceeding the maximum brightness as the expanded color space 110*a*.

FIG. 18 illustrates the value of the expanded color space maximum brightness Vmax(S) corresponding to the hue at the maximum saturation $S_0$ in the expanded color space 110*a*. In FIG. 18, the horizontal axis indicates the hue H (°), and the vertical axis indicates the maximum brightness Vmax. The first sub-pixel 49R displays red (R) with the hue of 0° or 360°, so that the expanded color space maximum brightness Vmax(S) with the hue of 0° or 360° is the first sub-pixel maximum brightness $V_1$. The second sub-pixel 49G displays green (G) with the hue of 120°, so that the expanded color space maximum brightness Vmax(S) with the hue of 120° is the second sub-pixel maximum brightness $V_2$. The third sub-pixel 49B displays blue (B) with the hue of 240°, so that the expanded color space maximum brightness Vmax(S) with the hue of 240° is the third sub-pixel maximum brightness $V_3$. That is, the expanded color space maximum brightness Vmax(S) varies with the hue in the expanded color space.

When the hue is 0° (red) to 120° (green), the expanded color space maximum brightness Vmax(S) is the first sub-pixel maximum brightness $V_1$ to the second sub-pixel maximum brightness $V_2$. When the hue is 120° (green) to 240° (blue), the expanded color space maximum brightness Vmax(S) is equal to or smaller than the second sub-pixel maximum brightness $V_2$, and equal to or larger than the third sub-pixel maximum brightness $V_3$. When the hue is 240° (blue) to 360° (red), the expanded color space maximum brightness Vmax(S) is the third sub-pixel maximum brightness $V_3$ to the first sub-pixel maximum brightness $V_1$.

In the expanded color space 110*a*, the expanded color space maximum brightness Vmax(S) gradually changes with the hue H. More specifically, a predetermined hue in a range from the hue 0° to the hue 120° is referred to as a hue H11. A predetermined hue in a range from the hue H11 to the hue 120° is referred to as a hue H12. A predetermined hue in a range from the hue 120° to the hue 240° is referred to as a hue H13. A predetermined hue in a range from the hue H13 to the hue 240° is referred to as a hue H14. A predetermined hue in a range from the hue 240° to the hue 360° is referred to as a hue H15. A predetermined hue in a range from the hue H15 to the hue 360° is referred to as a hue H16. For example, the hue H13 is the hue of a first intermediate color, and the hue H14 is the hue of a second intermediate color.

In the expanded color space 110*a*, the expanded color space maximum brightness Vmax(S) at the maximum saturation $S_0$ is the first sub-pixel maximum brightness $V_1$ with the hue in a range from 0° to H11. In the expanded color space 110*a*, with the hue in a range from H11 to H12, the expanded color space maximum brightness Vmax(S) at the maximum saturation $S_0$ linearly increases from the first sub-pixel maximum brightness $V_1$ to the second sub-pixel maximum brightness $V_2$ with the change of the hue from H11 to H12. In the expanded color space 110*a*, with the hue in a range from H12 to H13 through 120°, the expanded color space maximum brightness Vmax(S) at the maximum saturation $S_0$ is the second sub-pixel maximum brightness $V_2$.

In the expanded color space 110*a*, with the hue in a range from H13 to H14, the expanded color space maximum brightness Vmax(S) at the maximum saturation $S_0$ linearly decreases from the second sub-pixel maximum brightness $V_2$ to the third sub-pixel maximum brightness $V_3$ with the change of the hue from H13 to H14. In the expanded color space 110*a*, with the hue in a range from H14 to H15 through 240°, the expanded color space maximum brightness Vmax(S) at the maximum saturation $S_0$ is the third sub-pixel maximum brightness $V_3$.

In the expanded color space 110*a*, with the hue in a range from H15 to H16, the expanded color space maximum brightness Vmax(S) at the maximum saturation $S_0$ linearly increases from the third sub-pixel maximum brightness $V_3$ to the first sub-pixel maximum brightness $V_1$ with the change of the hue from H15 to H16. In the expanded color space 110*a*, with the hue in a range from H16 to 360°, the expanded color space maximum brightness Vmax(S) at the maximum saturation $S_0$ is the first sub-pixel maximum brightness $V_1$.

The expanded color space storage unit 73*a* determines the hues H11, H12, H13, H14, H15, and H16 based on the written value of the expanded color space maximum brightness Vmax(S) corresponding to the saturation S with the hues of the first color, the second color, and the third color.

In the expanded color space 110*a*, as the saturation S decreases from the maximum saturation $S_0$, the expanded color space maximum brightness Vmax(S) increases according to the line segments C1, C2, and C3 for each hue. That is, the expanded color space 110*a* is obtained by adding, to a cylindrical color space having a height of $V_{1\text{-}3}$ ($V_3$) similar to the expanded color space 110, a color space having substantially a trapezoidal shape in which the expanded color space maximum brightness Vmax(S) of the brightness V decreases as the saturation S increases, part of the trapezoidal shape being chipped according to the hue H. The expanded color space storage unit 73*a* derives and stores the expanded color space 110*a* described above based on the value of the expanded color space maximum brightness Vmax(S) corresponding to the saturation with the hues of the first color, the second color, and the third color. The display device 10*a* according to the second embodiment expands the input signal to widen the color space that can be extended from a cylindrical color space that is part of the expanded color space 110*a* to the entire expanded color space 110*a*, and displays the color.

The maximum set brightness calculation unit 74*a* reads out the data of the expanded color space 110*a* described above from the expanded color space storage unit 73*a*. The maximum set brightness calculation unit 74*a* calculates the maximum set brightness VAmax for all of the pixels 48 within one frame from the panel average input value $I_{AV}$ and the data of the expanded color space 110*a* corresponding to the value of the hue H of the pixel 48. Subsequent processing of calculating the input expansion signal and the output signal performed by the signal processing unit 20*a* according to the second embodiment is the same as that in the first embodiment.

In this way, the display device 10*a* according to the second embodiment determines the maximum set brightness VAmax within a range of the brightness that can be displayed in the expanded color space 110*a*, and so that the maximum set brightness VAmax increases as the panel average input value $I_{AV}$ decreases, without limiting the brightness of the first sub-pixel 49R and the second sub-pixel 49G. The expanded color space 110*a* is a color space extended with the first color, the second color, and the third color in a case in which the first sub-pixel 49R displays the color of the first sub-pixel maximum brightness $V_1$, the second sub-pixel 49G displays the color of the second sub-pixel maximum brightness $V_2$, and the third sub-pixel 49B displays the color of the third sub-pixel maximum brightness $V_3$. That is, the color having the brightness higher than that in the expanded color space 110 according to the first embodiment can be extended in the expanded color space 110*a*. Accordingly, the display device 10*a* according to the second embodiment can increase the brightness difference among the pixels within one frame more appropriately, and can improve the contrast of the image more appropriately.

Figure 19:
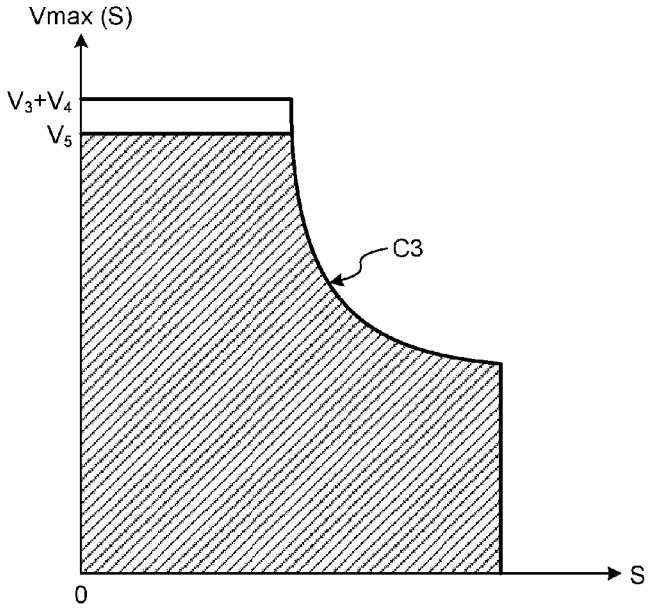
FIG. 19 is a conceptual diagram for explaining a color space in a case in which a maximum brightness is limited.

In the second embodiment, to display white having the maximum brightness, as illustrated in FIG. 17, the display device 10*a* displays white of which the saturation S is 0 and the brightness V is such that the maximum brightness is plotted as the brightness $V_3+V_4$. In this case, the input signal of each sub-pixel 49 is a signal value of the maximum gradation, and expanded to the maximum. However, for example, the display device 10*a* may limit the maximum brightness of white by a setting. FIG. 19 is a conceptual diagram for explaining the color space in a case in which the maximum brightness is limited. As illustrated in FIG. 19, the display device 10*a* limits the maximum brightness so that the maximum brightness of white is $V_5$ that is smaller than $V_3+V_4$. In this case, to display white having the maximum brightness, the display device 10*a* causes the signal processing unit 20*a* to generate a specified output signal obtained by limiting the output signal value, which is the input signal value of the maximum gradation being expanded to the maximum, so that the maximum brightness of white is $V_5$.

However, even in such a case, to display the color other than white, the display device 10*a* can expand the set brightness $VA_{(p,\ q)}$ to the brightness that is equal to or larger than $V_5$ within the expanded color space. In this case, in addition to the first sub-pixel 49R and the second sub-pixel 49G, the third sub-pixel 49B can also expand the brightness to be equal to or larger than the set brightness $V_5$.

Third Embodiment

The following describes a third embodiment of the present invention. A display device 10*b* according to the third embodiment is different from the display device 10*a* according to the second embodiment in that a pixel includes the first sub-pixel, the second sub-pixel, and the third sub-pixel, but not the fourth sub-pixel. The configuration of the display device 10*b* according to the third embodiment is the same as that of the display device 10*a* according to the second embodiment except the fourth sub-pixel, so that redundant description will not be repeated.

Figure 20:
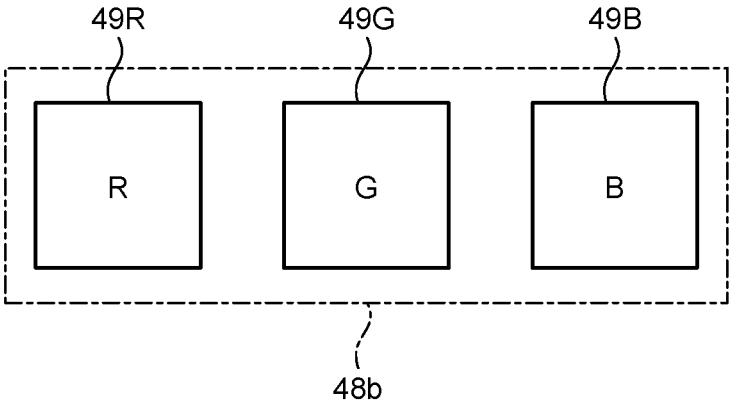
FIG. 20 is a diagram illustrating an array of sub-pixels of an image display panel according to a third embodiment.

FIG. 20 is a diagram illustrating an array of sub-pixels of the image display panel according to the third embodiment. As illustrated in FIG. 20, a pixel 48*b* included in this image display panel 40*b* according to the third embodiment includes the first sub-pixel 49R, the second sub-pixel 49G, and the third sub-pixel 49B. The image display panel 40*b* according to the third embodiment does not include the fourth sub-pixel 49W.

Figure 21:
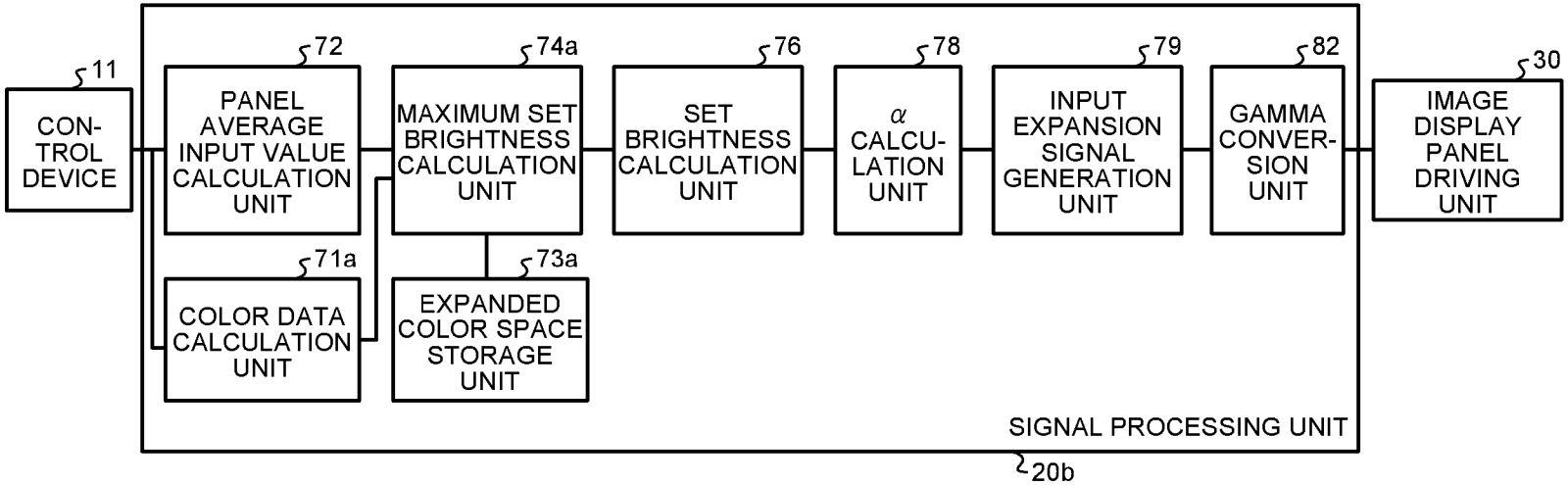
FIG. 21 is a block diagram illustrating the configuration of a signal processing unit according to the third embodiment.

FIG. 21 is a block diagram illustrating the configuration of a signal processing unit according to the third embodiment. Unlike the signal processing unit 20*a* according to the second embodiment illustrated in FIG. 16, a signal processing unit 20*b* according to the third embodiment does not include the W-conversion processing unit as illustrated in FIG. 21. The signal processing unit 20*b* outputs the input value of the input signal displayed by combining the colors of red, green, and blue as a signal value of red, green, and blue without converting the input value into a signal value of red, green, blue, and white. That is, the signal processing unit 20*b* sets the input expansion signal to be the output signal without performing W-conversion on the input expansion signal.

Figure 22:
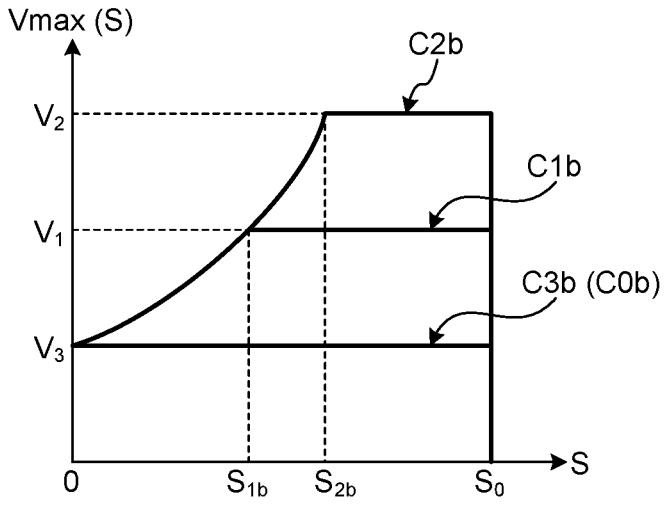
FIG. 22 is a conceptual diagram illustrating a relation between a hue and a brightness in an expanded color space according to the third embodiment.
Figure 23:
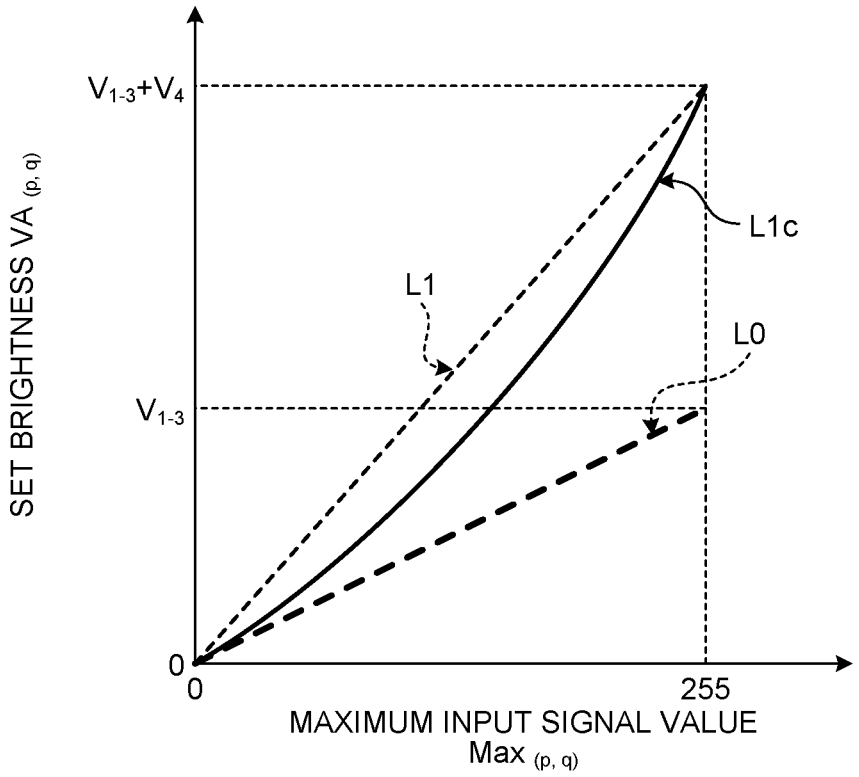
FIG. 23 is a graph illustrating an example of a relation between a signal value of an input signal and a set brightness according to the third embodiment.

The following describes an expanded color space 110*b* stored by the signal processing unit 20*b* according to the third embodiment. FIG. 22 is a conceptual diagram illustrating a relation between the hue and the brightness in the expanded color space according to the third embodiment. When the white component of the fourth sub-pixel 49W is not added, a standard color space 100*b* according to the third embodiment is a cylindrical HSV color space similarly to the standard color space 100 according to the first embodiment. That is, the standard color space 100*b* is a color space within the expanded color space maximum brightness Vmax(S) indicated by a line segment C0*b* in FIG. 22. As indicated by the line segment C0*b*, in the standard color space 100*b* in this case, the expanded color space maximum brightness Vmax(S) is the third sub-pixel maximum brightness $V_3$ irrespective of the saturation S.

A line segment C1*b* in FIG. 22 indicates the expanded color space maximum brightness Vmax(S) corresponding to the saturation in a case of displaying the color of the hue of the first color (for example, red) with only the first sub-pixel 49R without limiting the expanded color space maximum brightness Vmax(S). That is, the line segment C1*b* indicates the upper limit value of the color space extended with the hue of the first color (for example, red) in a case of outputting the output signal for displaying the color of the first sub-pixel maximum brightness $V_1$ to the first sub-pixel 49R by expanding the input signal.

A line segment C2*b* in FIG. 22 indicates the expanded color space maximum brightness Vmax(S) corresponding to the saturation in a case of displaying the color of the hue of the second color (for example, green) with only the second sub-pixel 49G without limiting the expanded color space maximum brightness Vmax(S). That is, the line segment C2*b* indicates the upper limit value of the color space extended with the hue of the second color (for example, green) in a case of outputting the output signal for displaying the color of the second sub-pixel maximum brightness $V_2$ to the second sub-pixel 49G by expanding the input signal.

A line segment C3*b* in FIG. 22 indicates the expanded color space maximum brightness Vmax(S) corresponding to the saturation in a case of displaying the color of the hue of the third color (for example, blue) with only the third sub-pixel 49B without limiting the expanded color space maximum brightness Vmax(S). That is, the line segment C3*b* indicates the upper limit value of the color space extended with the hue of the third color (for example, blue) in a case of outputting the output signal for displaying the color of the third sub-pixel maximum brightness $V_3$ to the third sub-pixel 49B. The line segment C3*b* corresponds to the third sub-pixel maximum brightness $V_3$, so that the line segment C3*b* is the same as the line segment C0*b* of the standard color space 100*b*.

As indicated by the line segment C1*b*, in a case in which the brightness is not limited, the expanded color space maximum brightness Vmax(S) of the hue of the first color (for example, red) is the first sub-pixel maximum brightness $V_1$ when the saturation is in a range from $S_0$ to $S_{1b}$. The expanded color space maximum brightness Vmax(S) decreases as the saturation decreases from the saturation $S_{1b}$ to the saturation 0. The expanded color space maximum brightness Vmax(S) is the third sub-pixel maximum brightness $V_3$ at the saturation 0.

As indicated by the line segment C2*b*, in a case in which the brightness is not limited, the expanded color space maximum brightness Vmax(S) of the hue of the second color (for example, green) is the second sub-pixel maximum brightness $V_2$ when the saturation is in a range from $S_0$ to $S_{2b}$. The expanded color space maximum brightness Vmax (S) decreases as the saturation decreases from the saturation $S_{2b}$ to the saturation 0. The expanded color space maximum brightness Vmax(S) is the third sub-pixel maximum brightness $V_3$ at the saturation 0.

As described above, the line segment C3*b* takes the same value as the line segment C0*b*. Accordingly, in a case in which the brightness is not limited, the maximum brightness with the hue of the third color (for example, blue) is the same as the expanded color space maximum brightness Vmax(S) in the standard color space 100*b*. The line segments C1*b*, C2*b*, and C3*b* are merely examples, and differ depending on the color and the like displayed by each sub-pixel.

In the expanded color space 110*b* according to the third embodiment, the maximum brightness with the hues of the first color, the second color, and the third color at the saturation $S_0$ is the same value as that in the expanded color space 110*a* according to the second embodiment. Thus, a relation between the saturation and the maximum brightness for each hue at the saturation $S_0$ is the same as that illustrated in FIG. 18 similarly to the second embodiment. The expanded color space storage unit 73*a* according to the third embodiment combines the values of the expanded color space maximum brightness Vmax(S) corresponding to the saturation with the hues of the first color, the second color, and the third color as illustrated in FIG. 22 to calculate the value of the expanded color space maximum brightness Vmax(S) corresponding to the saturation of each hue, and stores the color space within the maximum brightness as the expanded color space 110*b*.

The display device 10*b* according to the third embodiment can expand the color displayed by the image display panel 40*b* to a color that can be extended in the expanded color space 110*b*. To expand the color displayed by the image display panel 40*b* to the color that can be extended in the expanded color space 110*b*, the signal processing unit 20*b* of the display device 10*b* performs processing similar to the processing performed by the signal processing unit 20*a* according to the second embodiment. However, the signal processing unit 20*b* does not generate the output signal of the fourth sub-pixel 49W.

In this way, the display device 10*b* according to the third embodiment determines the maximum set brightness VAmax within a range of the brightness that can be displayed in the expanded color space 110*b* so that the maximum set brightness VAmax increases as the panel average input value $I_{AV}$ decreases without limiting the brightness of the first sub-pixel 49R and the second sub-pixel 49G. The expanded color space 110*b* can extend the color having a higher brightness than that in the standard color space 100*b*. Accordingly, the display device 10*b* according to the third embodiment can increase the brightness difference among the pixels within one frame, and appropriately improve the contrast of the image.

Fourth Embodiment

The following describes a fourth embodiment of the present invention. A relation between the maximum input signal value $Max_{(p, q)}$ and the set brightness $VA_{(p, q)}$ (set brightness data) in a display device 10*c* according to the fourth embodiment is different from that of the first embodiment. The configuration of the display device 10*c* according to the fourth embodiment is the same as that of the display device 10 according to the first embodiment except this relation, so that redundant description will not be repeated.

FIGS. 23 to 27 are graphs illustrating an example of the relation between the signal value of the input signal and the set brightness according to the forth embodiment. The relation between the maximum input signal value $Max_{(p, q)}$ and the set brightness $VA_{(p, q)}$ is not limited to that described in the first embodiment, and can be arbitrarily set so long as the set brightness $VA_{(p, q)}$ increases as the input signal value increases. For example, as indicated by a line segment L1*c* in FIG. 23, in the fourth embodiment, a rate of increase in the set brightness $VA_{(p, q)}$ increases as the input value of the input signal increases, in other words, as the maximum input signal value $Max_{(p, q)}$ increases. In this case, a rate of change of the set brightness $VA_{(p, q)}$ due to the input value of the input signal increases, so that the brightness difference among the pixels within one frame can be increased more appropriately, and the contrast of the image can be appropriately improved.

Figure 24:
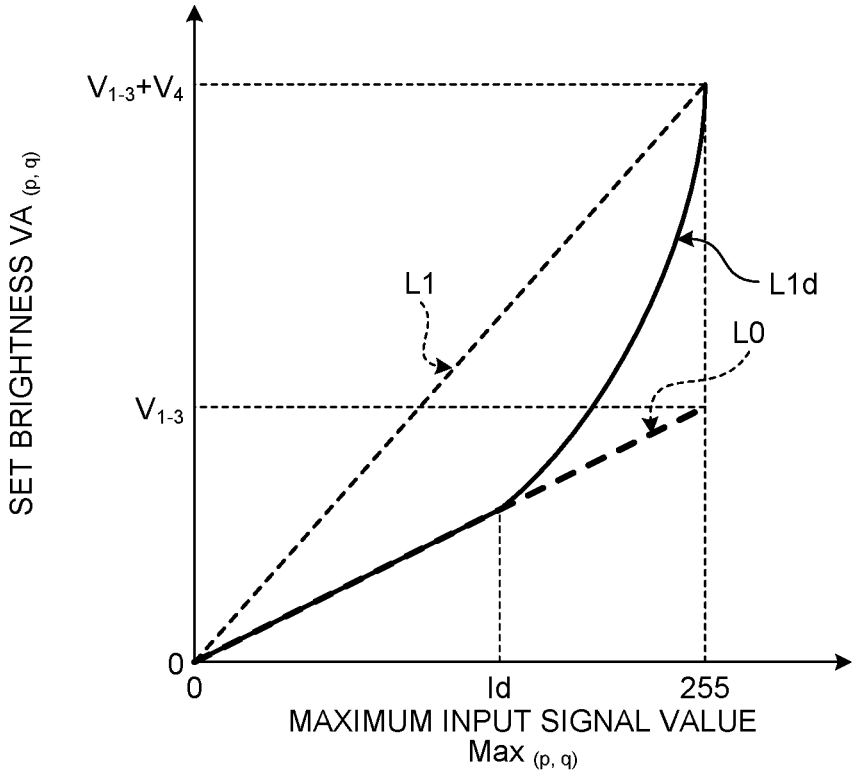
FIG. 24 is a graph illustrating an example of the relation between the signal value of the input signal and the set brightness according to the third embodiment.

For example, as illustrated in FIG. 24, the set brightness $VA_{(p, q)}$ may be increased according to the line segment L0 when the maximum input signal value $Max_{(p, q)}$ increases from 0 to Id, and the set brightness $VA_{(p, q)}$ may be increased according to a line segment L1*d* when the maximum input signal value $Max_{(p, q)}$ increases from Id to 255. The maximum input signal value Id can be arbitrarily set so long as the value is larger than 0 and smaller than 255. Regarding the line segment L1*d*, the rate of increase in the set brightness $VA_{(p, q)}$ increases as the input value of the input signal increases (as the maximum input signal value $Max_{(p, q)}$ increases). That is, the rate of increase in the set brightness $VA_{(p, q)}$ is constant when the maximum input signal value $Max_{(p, q)}$ increases from 0 to Id, and the rate of increase in the set brightness $VA_{(p, q)}$ may increase as the input value of the input signal increases (as the maximum input signal value $Max_{(p, q)}$ increases) when the maximum input signal value $Max_{(p, q)}$ increases from Id to 255. In this case, the set brightness $VA_{(p, q)}$ can be made small when the maximum input signal value $Max_{(p, q)}$ is small, and the set brightness $VA_{(p, q)}$ can be increased when the maximum input signal value $Max_{(p, q)}$ is large. Accordingly, in this case, the brightness difference among the pixels within one frame can be increased more appropriately, and the contrast of the image can be appropriately improved.

Figure 25:
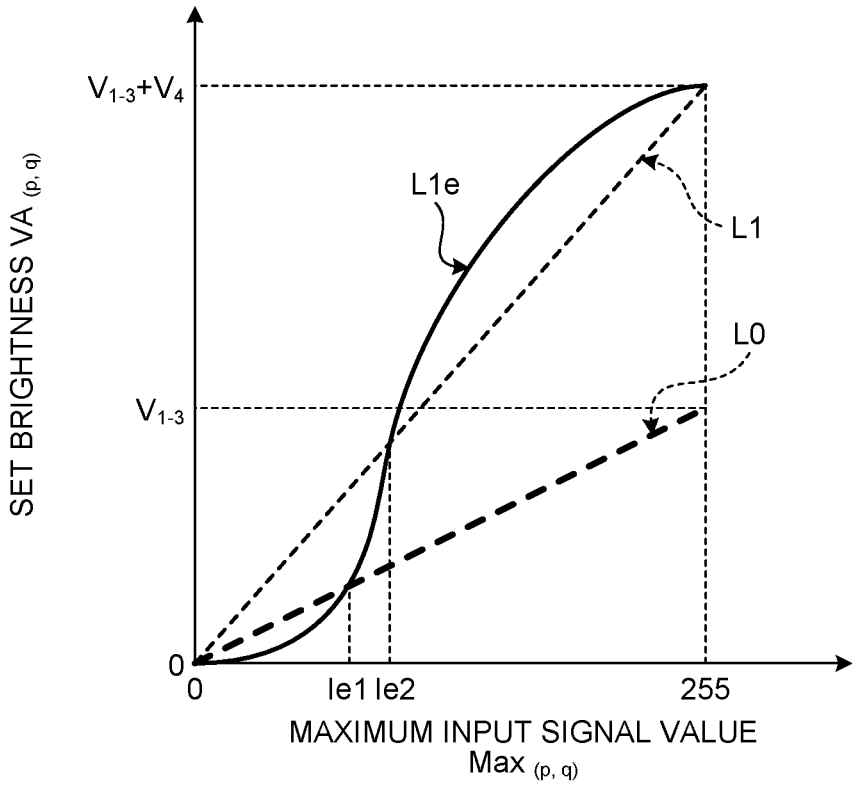
FIG. 25 is a graph illustrating an example of the relation between the signal value of the input signal and the set brightness according to the third embodiment.
Figure 26:
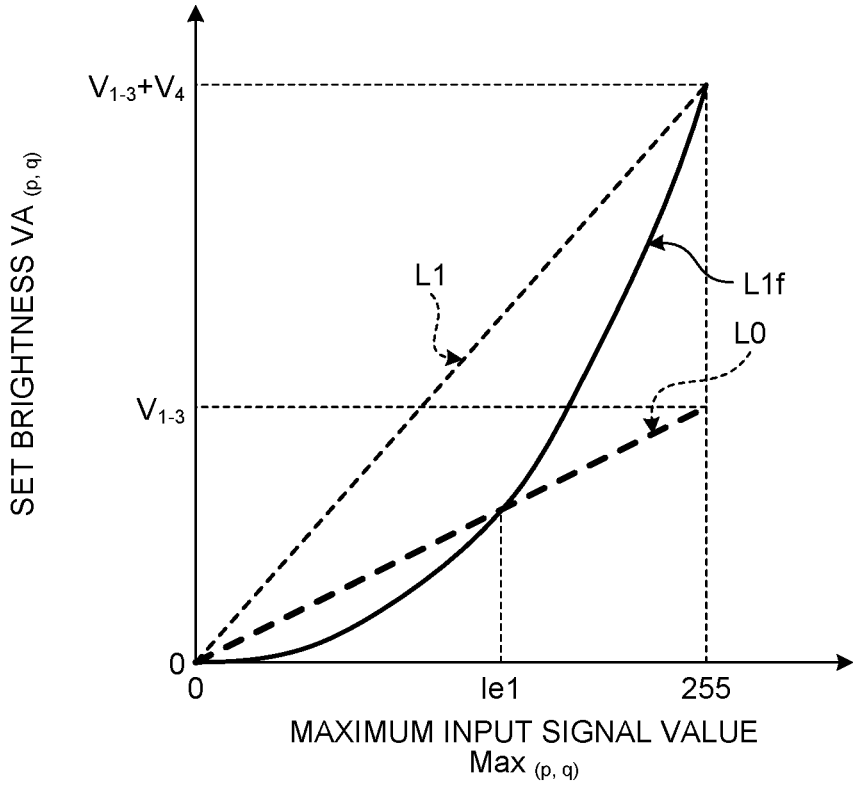
FIG. 26 is a graph illustrating an example of the relation between the signal value of the input signal and the set brightness according to the third embodiment.

For example, as indicated by a line segment L1*e* in FIG. 25, the set brightness $VA_{(p, q)}$ may be equal to or smaller than the brightness of the color displayed according to the line segment L0 when the maximum input signal value $Max_{(p, q)}$ is equal to or smaller than Ie1, and the set brightness $VA_{(p, q)}$ may be equal to or larger than the brightness of the color displayed according to the line segment L0 when the maximum input signal value $Max_{(p, q)}$ is larger than Ie1. Also in this case, as indicated by the line segment L1*e*, the set brightness $VA_{(p,\ q)}$ increases as the input signal value increases. Regarding the line segment L1*e*, the set brightness $VA_{(p,\ q)}$ is 0 when the maximum input signal value $Max_{(p,\ q)}$ is 0, and the set brightness $VA_{(p,\ q)}$ is the maximum brightness $V_{1\text{-}3}+V_4$ when the maximum input signal value $Max_{(p,\ q)}$ is 255. Regarding the line segment L1*e*, when the maximum input signal value $Max_{(p,\ q)}$ is equal to or larger than Ie2, the set brightness $VA_{(p,\ q)}$ is equal to or larger than the brightness of the color displayed according to the line segment L1. That is, the line segment L1*e* draws an S-shaped curve that is convex downward when the maximum input signal value $Max_{(p,\ q)}$ is Ie1 and convex upward when the maximum input signal value $Max_{(p,\ q)}$ is Ie2.

In this case, the set brightness $VA_{(p,\ q)}$ can made small when the maximum input signal value $Max_{(p,\ q)}$ is small, and the set brightness $VA_{(p,\ q)}$ can be increased when the maximum input signal value $Max_{(p,\ q)}$ is large. Accordingly, in this case, the brightness difference among the pixels within one frame can be increased more appropriately, and the contrast of the image can be appropriately improved. The maximum input signal values Ie1 and Ie2 can be arbitrarily set so long as each of the values is larger than 0 and smaller than 255.

The set brightness $VA_{(p,\ q)}$ is not limited to the line segment L1*e* so long as the set brightness $VA_{(p,\ q)}$ is equal to or smaller than the brightness of the color displayed according to the line segment L0 when the maximum input signal value $Max_{(p,\ q)}$ is equal to or smaller than Ie1, and the set brightness $VA_{(p,\ q)}$ is equal to or larger than the brightness of the color displayed according to the line segment L0 when the maximum input signal value $Max_{(p,\ q)}$ is larger than Ie1. The line segment L1*e* draws a curve according to the maximum input signal value $Max_{(p,\ q)}$. Alternatively, the line segment L1*e* may draw a straight line with a point of inflection. For example, as indicated by a line segment L1*f* in FIG. 26, the set brightness $VA_{(p,\ q)}$ is equal to or smaller than the brightness of the color displayed according to the line segment L1, and is not necessarily larger than the brightness of the color displayed according to the line segment L1. The line segment L1*f* is convex downward, and corresponds to a gamma curve of a display. Also in this case, the brightness difference among the pixels within one frame can be increased more appropriately, and the contrast of the image can be appropriately improved.

Figure 27:
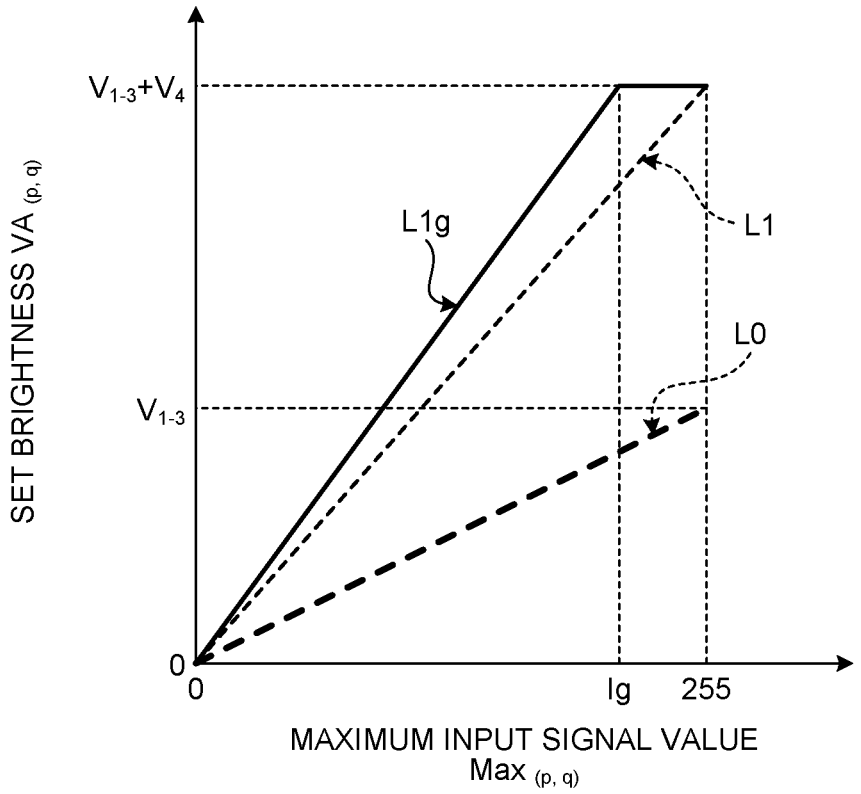
FIG. 27 is a graph illustrating an example of the relation between the signal value of the input signal and the set brightness according to the third embodiment.

For example, as indicated by a line segment L1*g* in FIG. 27, the set brightness $VA_{(p,\ q)}$ may be the maximum brightness $V_{1\text{-}3}+V_4$ in a case in which the maximum input signal value $Max_{(p,\ q)}$ is equal to or larger than Ig that is a predetermined value smaller than 255 as the maximum value. In this case, as compared with the line segment L1, for example, the rate of increase in the set brightness $VA_{(p,\ q)}$ along with the increase in the maximum input signal value $Max_{(p,\ q)}$ can be increased. Accordingly, also in this case, the brightness difference among the pixels within one frame can be increased more appropriately, and the contrast of the image can be appropriately improved.

In this way, the relation between the maximum input signal value $Max_{(p,\ q)}$ and the set brightness $VA_{(p,\ q)}$ can be arbitrarily set so long as the set brightness $VA_{(p,\ q)}$ increases as the input signal value increases. The display device 10*c* determines the input expansion coefficient $\alpha$ so that the brightness of the color to be displayed is the set brightness $VA_{(p,\ q)}$ calculated as described above.

Figure 28:
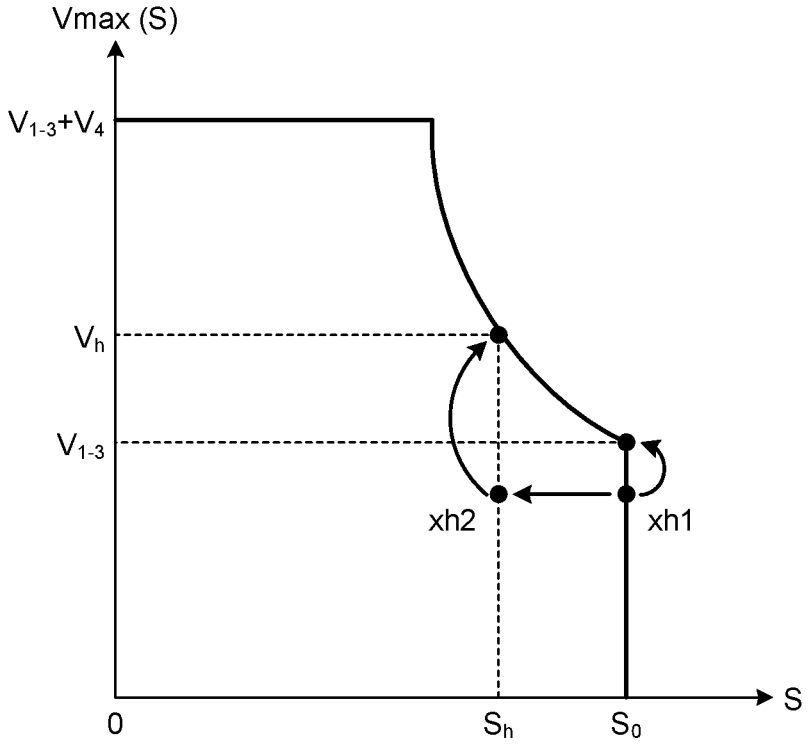
FIG. 28 is a conceptual diagram of the expanded color space.

For example, when the saturation S of the pixel 48 is large and the corrected maximum set brightness $VAmax\mathbf{1}_{(p,\ q)}$ as the displayable maximum brightness is small, the set brightness $VA_{(p,\ q)}$ may be small. In this case, the display device 10*c* may convert the value of the saturation S of the pixel 48 to be small and set the corrected maximum set brightness $VAmax\mathbf{1}_{(p,\ q)}$ to be large to increase the set brightness $VA_{(p,\ q)}$. FIG. 28 is a conceptual diagram of the expanded color space. As illustrated in FIG. 28, in the pixel 48 to which a predetermined input signal xh1 is input, the corrected maximum set brightness $VAmax\mathbf{1}_{(p,\ q)}$ is the maximum brightness $V_{1\text{-}3}$ when the saturation based on the input signal xh1 is $S_0$. In this case, for example, the display device 10*c* may convert the input signal xh1 of the pixel 48 into a converted input signal xh2 the saturation of which is $S_h$ that is lower than $S_0$. At the saturation $S_h$ of the converted input signal xh2, the corrected maximum set brightness $VAmax\mathbf{1}_{(p,\ q)}$ is $V_h$ that is larger than the maximum brightness $V_{1\text{-}3}$. The display device 10*c* determines the corrected maximum set brightness $VAmax\mathbf{1}_{(p,\ q)}$ based on the converted input signal xh2, and increases the corrected maximum set brightness $VAmax\mathbf{1}_{(p,\ q)}$. In this case, the set brightness $VA_{(p,\ q)}$ can be increased, so that the brightness difference among the pixels within one frame can be increased more appropriately, and the contrast of the image can be appropriately improved.

Modification

The following describes a modification of the first embodiment. In the first embodiment, the signal processing unit 20 calculates the output signal of each sub-pixel according to the expressions (14), and (17) to (19). That is, in the first embodiment, the signal processing unit 20 expands the input signal of each pixel with the input expansion coefficient $\alpha_{(p,\ q)}$ to generate the input expansion signal, and generates the output signal without performing expansion processing on the input expansion signal. However, as described below, a signal processing unit 20*d* according to the modification reduces the signal value of the input signal of each sub-pixel to generate a corrected input signal, expands the corrected input signal with the input expansion coefficient $\alpha_{(p,\ q)}$ to generate a corrected input expansion signal, and performs expansion processing on the corrected input signal again to generate the output signal.

Specifically, the signal processing unit 20*d* calculates a corrected input signal $xB_{1\text{-}(p,\ q)}$ of the first sub-pixel based on the input signal $x_{1\text{-}(p,\ q)}$ of the first sub-pixel and a correction coefficient $\alpha_{max}$. Similarly, the signal processing unit 20*d* calculates a corrected input signal $xB_{2\text{-}(p,\ q)}$ of the second sub-pixel based on the input signal $x_{2\text{-}(p,\ q)}$ of the second sub-pixel and the correction coefficient $\alpha_{max}$. Similarly, the signal processing unit 20*d* calculates a corrected input signal $xB_{3\text{-}(p,\ q)}$ of the third sub-pixel based on the input signal $x_{3\text{-}(p,\ q)}$ of the third sub-pixel and the correction coefficient $\alpha_{max}$. Specifically, the signal processing unit 20*d* generates corrected input signals of the sub-pixels based on the following expressions (21) to (23).

$$xB_{1\text{-}(p,q)}=x_{1\text{-}(p,q)}/\alpha_{max} \tag{21}$$

$$xB_{2\text{-}(p,q)}=x_{2\text{-}(p,q)}/\alpha_{max} \tag{22}$$

$$xB_{3\text{-}(p,q)}=x_{3\text{-}(p,q)}/\alpha_{max} \tag{23}$$

The correction coefficient $\alpha_{max}$ is a coefficient set for reducing the signal value of the input signal, that is, a value larger than 1. Accordingly, the signal value of the corrected input signal of each sub-pixel is smaller than the signal value of the input signal. In this modification, the correction coefficient $\alpha_{max}$ is set as a value equal to or larger than the maximum value that the input expansion coefficient $\alpha_{(p,\ q)}$ can take. For example, the correction coefficient $\alpha_{max}$ is $1+\chi$. The signal processing unit 20*d* stores the correction coefficient $\alpha_{max}$ as a coefficient determined in advance.

Subsequently, the signal processing unit 20*d* calculates a corrected input expansion signal $xC_{1-(p,q)}$ of the first sub-pixel based on the corrected input signal $xB_{1-(p,q)}$ of the first sub-pixel and the input expansion coefficient $\alpha_{(p,q)}$. Similarly, the signal processing unit 20*d* calculates a corrected input expansion signal $xC_{2-(p,q)}$ of the second sub-pixel based on the corrected input signal $xB_{2-(p,q)}$ of the second sub-pixel and the input expansion coefficient $\alpha_{(p,q)}$. Similarly, the signal processing unit 20*d* calculates a corrected input expansion signal $xC_{3-(p,q)}$ of the third sub-pixel based on the corrected input signal $xB_{3-(p,q)}$ of the third sub-pixel and the input expansion coefficient $\alpha_{(p,q)}$. Specifically, the signal processing unit 20*d* generates corrected input expansion signals of the sub-pixels based on the following expressions (24) to (26).

$$xC_{1-(p,q)}=\alpha_{(p,q)}\cdot xB_{1-(p,q)} \tag{24}$$

$$xC_{2-(p,q)}=\alpha_{(p,q)}\cdot xB_{2-(p,q)} \tag{25}$$

$$xC_{3-(p,q)}=\alpha_{(p,q)}\cdot xB_{3-(p,q)} \tag{26}$$

In this modification, the correction coefficient $\alpha_{max}$ is a value equal to or larger than the maximum value that the input expansion coefficient $\alpha_{(p,q)}$ can take. Accordingly, the signal value of the corrected input expansion signal of each pixel is equal to or smaller than the maximum signal value (in this case, 255) of the input signal.

Subsequently, the signal processing unit 20*d* calculates the output signal $X_{4-(p,q)}$ of the fourth sub-pixel based on the corrected input expansion signal $xC_{1-(p,q)}$ of the first sub-pixel, the corrected input expansion signal $xC_{2-(p,q)}$ of the second sub-pixel, the corrected input expansion signal $xC_{3-(p,q)}$ of the third sub-pixel, and the correction coefficient $\alpha_{max}$. Specifically, the signal processing unit 20*d* calculates the output signal $X_{4-(p,q)}$ of the fourth sub-pixel based on the following expression (27).

$$X_{4-(p,q)}=\alpha_{max}\cdot \mathrm{Min}C_{(p,q)}/\chi \tag{27}$$

$\mathrm{Min}C_{(p,q)}$ is the minimum value among the corrected input expansion signal values ($xC_{1-(p,q)}$, $xC_{2-(p,q)}$, $xC_{3-(p,q)}$) of three sub-pixels 49.

The signal processing unit 20*d* calculates the output signal $X_{1-(p,q)}$ of the first sub-pixel based on the corrected input expansion signal $xC_{1-(p,q)}$ of the first sub-pixel, the output signal $X_{4-(p,q)}$ of the fourth sub-pixel, and the correction coefficient $\alpha_{max}$. Similarly, the signal processing unit 20*d* calculates the output signal $X_{2-(p,q)}$ of the second sub-pixel based on the corrected input expansion signal $xC_{2-(p,q)}$ of the second sub-pixel, the output signal $X_{4-(p,q)}$ of the fourth sub-pixel, and the correction coefficient $\alpha_{max}$. Similarly, the signal processing unit 20*d* calculates the output signal $X_{3-(p,q)}$ of the third sub-pixel based on the corrected input expansion signal $xC_{3-(p,q)}$ of the third sub-pixel, the output signal $X_{4-(p,q)}$ of the fourth sub-pixel, and the correction coefficient $\alpha_{max}$. Specifically, the signal processing unit 20*d* calculates the output signals of the first sub-pixel, the second sub-pixel, and the third sub-pixel based on the following expressions (28) to (30).

$$X_{1-(p,q)}=\alpha_{max}\cdot xC_{1-(p,q)}-\chi\cdot X_{4-(p,q)} \tag{28}$$

$$X_{2-(p,q)}=\alpha_{max}\cdot xC_{2-(p,q)}-\chi\cdot X_{4-(p,q)} \tag{29}$$

$$X_{3-(p,q)}=\alpha_{max}\cdot xC_{2-(p,q)}-\chi\cdot X_{4-(p,q)} \tag{30}$$

As described above, the signal processing unit 20*d* divides each of the input signals of the first sub-pixel, the second sub-pixel, and the third sub-pixel by the correction coefficient $\alpha_{max}$ to generate the corrected input signal. The signal processing unit 20*d* then multiplies each of the corrected input signals of the first sub-pixel, the second sub-pixel, and the third sub-pixel by the input expansion coefficient $\alpha_{(p,q)}$ to expand the corrected input signal, and generates the corrected input expansion signal. The signal processing unit 20*d* multiplies each of the corrected input expansion signals of the first sub-pixel, the second sub-pixel, and the third sub-pixel by the correction coefficient $\alpha_{max}$ to expand the corrected input expansion signal again, and generates the output signals of the first sub-pixel, the second sub-pixel, the third sub-pixel, and the fourth sub-pixel. In the modification, the signal processing unit 20*d* divides the input signal by the correction coefficient $\alpha_{max}$, and multiplies the quotient by the correction coefficient $\alpha_{max}$ thereafter, so that the signal value of the output signal is the same as that in the first embodiment. Accordingly, by performing the processing as described in the modification too, the signal processing unit 20*d* can appropriately improve the contrast of the image.

Before the processing of calculating the signal of the fourth sub-pixel, the signal processing unit 20*d* processes the input signal and the corrected input signal. As described above, the value of the corrected input signal is obtained by dividing the input signal by the correction coefficient $\alpha_{max}$, so that the signal value of the corrected input signal is equal to or smaller than the maximum gradation value (in this case, 255) of the input signal. Accordingly, in the signal processing unit 20*d*, a signal value to be handled is equal to or smaller than the maximum gradation value (in this case, 255) of the input signal before the processing of calculating the signal of the fourth sub-pixel. Thus, before the processing of calculating the signal of the fourth sub-pixel, the signal processing unit 20*d* can prevent the gradation value of the signal to be handled from increasing, and prevent a circuit scale from increasing.

Application Example

Figure 29:
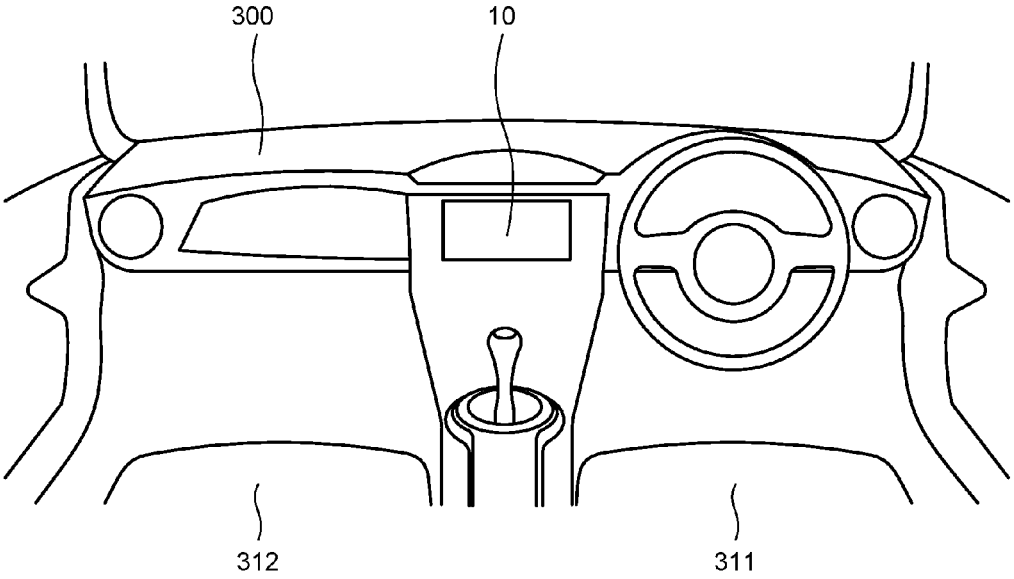
FIG. 29 is a diagram illustrating an example of an electronic apparatus to which the display device according to the first embodiment is applied.
Figure 30:
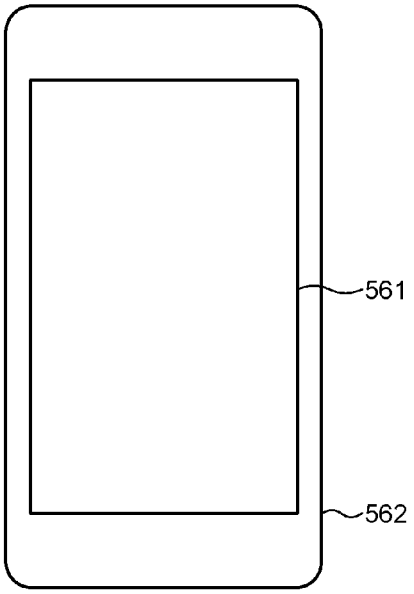
FIG. 30 is a diagram illustrating an example of the electronic apparatus to which the display device according to the first embodiment is applied.

With reference to FIGS. 29 and 30, the following describes application examples of the display device 10 described in the first embodiment. FIGS. 29 and 30 are diagrams each illustrating an example of an electronic apparatus to which the display device according to the first embodiment is applied. The display device 10 according to the first embodiment can be applied to electronic apparatuses in various fields such as a car navigation system illustrated in FIG. 29, a television apparatus, a digital camera, a notebook-type personal computer, a portable terminal device such as a cellular telephone illustrated in FIG. 30, and a video camera. In other words, the display device 10 according to the first embodiment can be applied to electronic apparatuses in various fields that display a video signal input from the outside or a video signal generated inside as an image or video. The electronic apparatus includes the control device 11 (refer to FIG. 1) that supplies the video signal to the display device and controls the operation of the display device. This application example can also be applied to the display devices according to the other embodiments and the modification described above in addition to the display device 10 according to the first embodiment.

The electronic apparatus illustrated in FIG. 29 is a car navigation device to which the display device 10 according to the first embodiment is applied. The display device 10 is mounted on a dashboard 300 inside an automobile. Specifically, the display device 10 is mounted on the dashboard 300 between a driver's seat 311 and a passenger seat 312. The display device 10 of the car navigation device is utilized for displaying navigation, displaying a music operation screen, reproducing and displaying a movie, or the like.

The electronic apparatus illustrated in FIG. 30 is a portable information terminal that operates as a portable computer, a multifunctional mobile phone, a mobile computer capable of making a voice call, or a mobile computer capable of performing communications to which the display device 10 according to the first embodiment is applied, and may be called a smartphone or a tablet terminal in some cases. The portable information terminal includes a display unit 561 on a surface of a housing 562, for example. The display unit 561 includes the display device 10 according to the first embodiment and has a touch detection (what is called a touch panel) function that can detect an external proximity object.

The embodiments of the present invention have been described above. However, the embodiments are not limited thereto. The components described above include a component that is easily conceivable by those skilled in the art, substantially the same component, and what is called an equivalent. The components described above can also be appropriately combined with each other. In addition, the components can be variously omitted, replaced, and modified without departing from the gist of the embodiments described above.

What is claimed is:

1. A display device comprising:

an image display panel including a plurality of pixels each including a first sub-pixel that displays a first color, a second sub-pixel that displays a second color, a third sub-pixel that displays a third color, and a fourth sub-pixel that displays a fourth color; and a signal processing unit that generates an output signal from an input value of an input signal, and outputs the output signal to the image display panel, wherein the signal processing unit stores an expanded color space extended with the first color, the second color, the third color, and the fourth color, determines maximum set brightness as an upper limit value of brightness of a color displayed by the image display panel so that the maximum set brightness is within a range of the brightness in the expanded color space, and the maximum set brightness increases as a panel average input value calculated based on an average value of input values of input signals to the pixels within one frame decreases, determines an input expansion coefficient for expanding the color displayed by the image display panel to a color of the maximum set brightness, obtains an input expansion signal of the first sub-pixel based on an input signal of the first sub-pixel and the input expansion coefficient, obtains an input expansion signal of the second sub-pixel based on an input signal of the second sub-pixel and the input expansion coefficient, obtains an input expansion signal of the third sub-pixel based on an input signal of the third sub-pixel and the input expansion coefficient, obtains an output signal of the first sub-pixel based on the input expansion signal of the first sub-pixel and outputs the output signal to the first sub-pixel, obtains an output signal of the second sub-pixel based on the input expansion signal of the second sub-pixel and outputs the output signal to the second sub-pixel, obtains an output signal of the third sub-pixel based on the input expansion signal of the third sub-pixel and outputs the output signal to the third sub-pixel, and obtains an output signal of the fourth sub-pixel based on the input expansion signal of the first sub-pixel, the input expansion signal of the second sub-pixel, and the input expansion signal of the third sub-pixel and outputs the output signal to the fourth sub-pixel, wherein the expanded color space is a color space that can extend a color of brightness higher than that in a standard color space extended with the first color, the second color, and the third color, wherein the signal processing unit sets a value of the maximum set brightness to be a value of standard color space maximum brightness as an upper limit value of brightness in the standard color space when the panel average input value is equal to or larger than a first input value smaller than a maximum input value as an upper limit value of the input value of the input signal, sets the value of the maximum set brightness to be a value of expanded color space maximum brightness as an upper limit value of brightness in the expanded color space when the panel average input value is equal to or smaller than a second input value smaller than the first input value, and increases the value of the maximum set brightness from the standard color space maximum brightness to the expanded color space maximum brightness as the panel average input value decreases from the first input value to the second input value.

2. A display device comprising:

an image display panel including a plurality of pixels each including a first sub-pixel that displays a first color, a second sub-pixel that displays a second color, and a third sub-pixel that displays a third color; and a signal processing unit that generates an output signal from an input value of an input signal, and outputs the output signal to the image display panel, wherein the third sub-pixel has third sub-pixel maximum brightness as a displayable upper limit value of brightness of the third color, which is smaller than one of first sub-pixel maximum brightness as a displayable upper limit value of brightness of the first color of the first sub-pixel and second sub-pixel maximum brightness as a displayable upper limit value of brightness of the second color of the second sub-pixel, and is equal to or smaller than the other of the first sub-pixel maximum brightness and the second sub-pixel maximum brightness, and the signal processing unit stores an expanded color space extended with the first color, the second color, and the third color in a case in which the output signal for displaying a color of the first sub-pixel maximum brightness is output to the first sub-pixel, the output signal for displaying a color of the second sub-pixel maximum brightness is output to the second sub-pixel, and the output signal for displaying a color of the third sub-pixel maximum brightness is output to the third sub-pixel, determines maximum set brightness as an upper limit value of brightness of a color displayed by the image display panel so that the maximum brightness is within a range of the brightness in the expanded color space, and the maximum set brightness increases as a panel average input value calculated based on an average value of input values of input signals to the pixels within one frame decreases, determines an input expansion coefficient for expanding the color displayed by the image display panel to a color of the maximum set brightness, obtains an input expansion signal of the first sub-pixel based on an input signal of the first sub-pixel and the input expansion coefficient, obtains an input expansion signal of the second sub-pixel based on an input signal of the second sub-pixel and the input expansion coefficient, obtains an input expansion signal of the third sub-pixel based on an input signal of the third sub-pixel and the input expansion coefficient, obtains an output signal of the first sub-pixel based on the input expansion signal of the first sub-pixel and outputs the output signal to the first sub-pixel, obtains an output signal of the second sub-pixel based on the input expansion signal of the second sub-pixel and outputs the output signal to the second sub-pixel, and obtains an output signal of the third sub-pixel based on the input expansion signal of the third sub-pixel and outputs the output signal to the third sub-pixel, wherein the expanded color space is a color space that can extend a color of brightness higher than that in a standard color space extended with the first color, the second color, and the third color in a case of outputting the output signal for displaying a color of displayable brightness having an upper limit value limited to the third sub-pixel maximum brightness to the first sub-pixel and the second sub-pixel, and outputting the output signal for displaying the color of the third sub-pixel maximum brightness to the third sub-pixel, wherein the signal processing unit sets a value of the maximum set brightness to be a value of standard color space maximum brightness as an upper limit value of brightness in the standard color space when the panel average input value is equal to or larger than a first input value smaller than a maximum input value as an upper limit value of the input value of the input signal, sets the value of the maximum set brightness to be a value of expanded color space maximum brightness as an upper limit value of brightness in the expanded color space when the panel average input value is equal to or smaller than a second input value smaller than the first input value, and increases the value of the maximum set brightness from the standard color space maximum brightness to the expanded color space maximum brightness as the panel average input value decreases from the first input value to the second input value.

3. The display device according to claim 1 or 2, wherein the signal processing unit determines the input expansion coefficient for each of the pixels so that set brightness as brightness of a color displayed based on the input expansion signal of the first sub-pixel, the input expansion signal of the second sub-pixel, and the input expansion signal of the third sub-pixel increases up to the maximum set brightness as the input value of the input signal to the pixel increases.

4. The display device according to claim 3, wherein the signal processing unit determines the input expansion coefficient so that a rate of increase in the set brightness increases as the input value of the input signal to the pixel increases.

5. The display device according to claim 4, wherein the signal processing unit sets the rate of increase in the set brightness to be constant when the input value of the input signal to the pixel increases up to an input signal threshold as a predetermined value larger than 0, and determines the input expansion coefficient so that, when the input value of the input signal to the pixel increases from the input signal threshold, the rate of increase in the set brightness increases as the input value of the input signal to the pixel increases.

6. The display device according to claim 3, wherein the signal processing unit sets the set brightness to be equal to or smaller than the brightness of the color displayed based on the input value of the input signal to the pixel when the input value of the input signal to the pixel is equal to or smaller than a predetermined input signal value as a predetermined value larger than 0, and determines the input expansion coefficient so that, when the input value of the input signal to the pixel is larger than the predetermined input signal value, the set brightness is equal to or larger than the brightness of the color displayed based on the input value of the input signal to the pixel and the set brightness increases up to the maximum set brightness as the input value of the input signal to the pixel increases.

7. An electronic apparatus comprising:

the display device according to claim 1 or 2; and a control device that controls the display device.

8. A display device comprising:

an image display panel including a plurality of pixels each including a first sub-pixel that displays a first color, a second sub-pixel that displays a second color, a third sub-pixel that displays a third color, and a fourth sub-pixel that displays a fourth color; and a signal processing unit that generates an output signal from an input value of an input signal, and outputs the output signal to the image display panel, wherein the signal processing unit stores an expanded color space extended with the first color, the second color, the third color, and the fourth color, determines maximum set brightness as an upper limit value of brightness of a color displayed by the image display panel so that the maximum set brightness is within a range of the brightness in the expanded color space, and the maximum set brightness increases as a panel average input value calculated based on an average value of input values of input signals to the pixels within one frame decreases, determines an input expansion coefficient for expanding the color displayed by the image display panel to a color of the maximum set brightness, obtains an input expansion signal of the first sub-pixel based on an input signal of the first sub-pixel and the input expansion coefficient, obtains an input expansion signal of the second sub-pixel based on an input signal of the second sub-pixel and the input expansion coefficient, obtains an input expansion signal of the third sub-pixel based on an input signal of the third sub-pixel and the input expansion coefficient, obtains an output signal of the first sub-pixel based on the input expansion signal of the first sub-pixel and outputs the output signal to the first sub-pixel, obtains an output signal of the second sub-pixel based on the input expansion signal of the second sub-pixel and outputs the output signal to the second sub-pixel, obtains an output signal of the third sub-pixel based on the input expansion signal of the third sub-pixel and outputs the output signal to the third sub-pixel, and obtains an output signal of the fourth sub-pixel based on the input expansion signal of the first sub-pixel, the input expansion signal of the second sub-pixel, and the input expansion signal of the third sub-pixel and outputs the output signal to the fourth sub-pixel, wherein the expanded color space is a color space that can extend a color of brightness higher than that in a standard color space extended with the first color, the second color, and the third color, wherein the signal processing unit determines the input expansion coefficient for each of the pixels so that set brightness as brightness of a color displayed based on the input expansion signal of the first sub-pixel, the input expansion signal of the second sub-pixel, and the input expansion signal of the third sub-pixel increases up to the maximum set brightness as the input value of the input signal to the pixel increases, wherein, the signal processing unit determines the input expansion coefficient so that a rate of increase in the set brightness increases as the input value of the input signal to the pixel increases, wherein, the signal processing unit sets the rate of increase in the set brightness to be constant when the input value of the input signal to the pixel increases up to an input signal threshold as a predetermined value larger than 0, and determines the input expansion coefficient so that, when the input value of the input signal to the pixel increases from the input signal threshold, the rate of increase in the set brightness increases as the input value of the input signal to the pixel increases.

* * * * *